US006444051B2

(12) United States Patent
Komatsubara et al.

(10) Patent No.: US 6,444,051 B2
(45) Date of Patent: Sep. 3, 2002

(54) METHOD OF MANUFACTURING A GRAIN-ORIENTED ELECTROMAGNETIC STEEL SHEET

(75) Inventors: Michiro Komatsubara; Kazuaki Tamura; Mitsumasa Kurosawa, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/927,030

(22) Filed: Aug. 9, 2001

Related U.S. Application Data

(62) Division of application No. 09/315,084, filed on May 19, 1999, now abandoned.

(30) Foreign Application Priority Data

May 21, 1998 (JP) ..... 10-139416
May 26, 1998 (JP) ..... 10-144233

(51) Int. Cl.[7] ..... H01F 1/147

(52) U.S. Cl. ..... 148/111; 148/113

(58) Field of Search ..... 148/110–113

(56) References Cited

U.S. PATENT DOCUMENTS

| | | | |
|---|---|---|---|
| 4,579,608 | A | 4/1986 | Shimizu et al. |
| 4,960,652 | A | 10/1990 | Wada et al. |
| 5,858,126 | A | 1/1999 | Takashima et al. |
| 5,885,371 | A | 3/1999 | Komatsubara et al. |
| 6,039,818 | A | 3/2000 | Toge et al. |
| 6,103,022 | A | 8/2000 | Komatsubara et al. |

FOREIGN PATENT DOCUMENTS

EP 0 869 190 A1 10/1998

*Primary Examiner*—John Sheehan
(74) *Attorney, Agent, or Firm*—Schnader Harrison Segal & Lewis LLP

(57) ABSTRACT

A method of making a grain-oriented electromagnetic steel sheet having a low iron loss and a high magnetic flux density, from a steel slab with 0.03 to 0.095 wt % carbon, about 1.5 to 7.0 wt % Si, about 0.03 to 2.50 wt % manganese, about 0.003 to 0.040 wt % sulfur and/or selenium, about 0.0010 to 0.0070 wt % borbon, about 30 to 120 wtppm nitrogen, about 0.015 wt % or less aluminum, and about 0.010 wt % or less vanadium by subjecting the steel slab to reheating, hot rolling, rapid cooling, cold rolling, primary recrystallization annealing, coating with an annealing separator, final annealing, secondary recrystallization, and coiling.

23 Claims, 6 Drawing Sheets

METHOD OF MANUFACTURING A GRAIN-ORIENTED ELECTROMAGNETIC STEEL SHEET

This application is a divisional of application Ser. No. 09/315,084, filed May 19, 1999, now abandoned.

BACKGROUND OF THE INVENTION

1. Field of the Invention

The present invention relates to a grain oriented silicon steel sheet used for the iron core of a transformer or a generator. The grain oriented electromagnetic steel sheet has a high magnetic flux density and improved iron loss properties, and is particularly suitable for enabling downsizing of a transformer. The invention further relates to a new method of manufacturing such grain oriented sheet, and to the slab from which it is made.

2. Description of the Related Art

A grain oriented electromagnetic steel sheet containing silicon and having crystal grains oriented in a (110)[001] or (100)[001] orientation has excellent soft magnetic properties. Such sheets widely serve as various iron core materials in the commercial frequency range. An important property that a grain oriented steel sheet is required to have in such uses is a low iron loss. The iron loss is usually evaluated as power loss upon magnetization at a frequency of 50 Hz to 1.7 T (hereinafter expressed as $W_{17/50}$ (W/kg).

Regarding the iron loss property of a commercial large-capacity transformer, those having a stacked iron core or a coiled iron core, constructed using a grain oriented electromagnetic steel sheet having low $W_{17/50}$ iron loss values are quite excellent. Further, a grain oriented electromagnetic steel sheet having a high magnetic flux density with an improved orientation of crystal grains is beneficial for the purpose of downsizing a large-capacity transformer. The consumption of such materials is increasing year by year, partly urged by the tendency toward energy saving.

In a grain oriented electromagnetic steel sheet, only crystal grains of a particular orientation are selectively caused to grow. This is done by utilization of a phenomenon known as secondary recrystallization.

In the usual process of manufacturing a grain oriented electromagnetic steel sheet, it is necessary to cause fine precipitation of an inhibitor in the steel. This is done by hot rolling after solid-solution treatment of the inhibitor, by heating to a high temperature a steel slab containing the inhibitor component in the steel. Simultaneous use of AlN and MnS as inhibitors, and simultaneous use of AlN and MnSe, are commonly employed for increasing the high magnetic flux density.

The inhibiting function of AlN is readily influenced by the secondary recrystallization annealing atmosphere. As a result, the magnetic properties of the sheet tend to become unstable.

There is disclosed a bismuth-containing grain oriented electromagnetic steel sheet with a view to achieving a high magnetic flux density. Japanese Unexamined Patent Publication No. 56-18044 discloses a method of manufacturing a grain oriented electromagnetic steel sheet, using MnS and MnSe as inhibitors, wherein bismuth is added to a steel slab and pre-rolling of the slab is finished at a temperature of up to 1,050° C.

Japanese Examined Patent Publication No. 56-21331 discloses a technique based on a combination of bismuth, AlN and MnS and a combination of bismuth, AlN and MnSe.

Japanese Examined Patent Publication No. 7-62176 discloses, as Example 3, a technique of annealing, for a minute, a hot-rolled steel sheet containing aluminum, sulfur and bismuth at 1,000° C. by use of a two-stage cold rolling, subjecting the resulting steel sheet to intermediate annealing at 1,050° C., rapidly cooling the same, and applying an aging treatment.

The technique disclosed in the aforementioned Japanese Unexamined Patent Publication No. 56-18044 provided, however, only an ineffective value of magnetic flux density.

In the techniques of the aforementioned Japanese Examined Patent Publication No. 56-21331 and Japanese Examined Patent Publication No. 7-62176, with the use of AlN as an inhibitor, the secondary recrystallization annealing atmosphere sometimes caused fluctuations of magnetic properties, resulting in an unstable iron loss value entirely unsuitable for industrial manufacturing.

A germanium-containing grain oriented electromagnetic steel sheet is disclosed as a technique for obtaining a low iron loss. Japanese Unexamined Patent Publication No. 59-31823 discloses a technique for obtaining a satisfactory value of $W_{17/50}$ by enriching the slab inner layer with germanium.

Japanese Unexamined Patent Publication No. 2-196403 discloses a technique for obtaining a satisfactory $W_{17/50}$ value based on a combination of germanium and AlN, or a combination of germanium, AlN and MnS, or a combination of germanium, AlN and MnSe.

In the technique disclosed in the aforementioned Japanese Unexamined Patent Publication No. 59-31823, however, it is essential to enrich the slab inner layer with germanium, making it industrially difficult to add wires upon slab casting. Reducing the size of secondary recrystallization grains is also unavailable.

In the technique disclosed in the aforementioned Japanese Unexamined Patent Publication No. 2-196403, on the other hand, it is essential to use AlN as an inhibitor. This may sometimes cause fluctuations of magnetic properties due to the effect of the atmosphere upon secondary recrystallization annealing, resulting in an unstable iron loss value. This technique is not acceptable for industrial application.

Under such circumstances, we carried out extensive studies of manufacturing techniques using an inhibitor other than MnS, MnSe or AlN. This resulted in development of a manufacturing technique using boron nitride as an inhibitor for making a grain oriented electromagnetic steel sheet having a high magnetic flux density. An application for patent was filed (Japanese Examined Patent Application No. 8-301474).

The use of BN as an inhibitor has been disclosed. For example, Japanese Examined Patent Publication No. 58-43445 discloses a technique using a steel containing from 0.0006 to 0.0080 wt % boron and 0.0100 wt % nitrogen. However, the grain oriented electromagnetic steel sheet so obtained has a magnetic flux density $B_8$ of only about 1.89 T at most, along with only a fair iron loss. The technique previously developed by the present inventors, in contrast, is based on a method using a combination of BN and MnS or BN and MnSe as an inhibitor, and changing the hot rolling conditions in response to the silicon content and the amount of added boron. According to this technique, it is possible to stably obtain a grain oriented electromagnetic steel sheet having a very high magnetic flux density. However, the demand for improvement of magnetic properties is still increasing for transformers and the like using grain oriented electromagnetic steel sheets from the point of view of product downsizing and energy saving. The grain oriented electromagnetic steel sheet serving as a material for iron cores is therefore required to have even a still higher magnetic flux density and a further reduced iron loss. Furthermore, in a BN-containing grain oriented electromagnetic steel sheet having a high magnetic flux density, crystal grains of the product tend to be coarser. In some cases, therefore, the iron loss value was not necessarily comparable to the magnetic flux density value. There has been room for improvement regarding achievement of a lower iron loss.

The present invention has therefore an object to provide a grain oriented electromagnetic steel sheet using BN as an inhibitor and having a further reduced iron loss and a high magnetic flux density.

SUMMARY OF THE INVENTION

We have discovered a new way to manufacture an electromagnetic steel sheet having a low iron loss and a high magnetic flux density. This is done by adding an element to the steel which accelerates not only precipitation of fine inhibitive BN in the steel but also achieves beneficial precipitation of silicon nitride during the manufacturing process, and radically improves the texture of the primary recrystallized grains of the steel sheet immediately before subjecting the same to secondary recrystallization annealing. This invention further combines a texture-improving treatment with primary recrystallization annealing and cold rolling.

More specifically, addition of bismuth or germanium into the steel, or both, with the application of appropriate primary recrystallization annealing conditions is effective as a step in the process.

Further, such a combination with addition of germanium into the steel, and application of appropriate primary recrystallization annealing conditions with warm rolling, is particularly effective.

In addition to the above-mentioned findings, we have found how to achieve acceleration of beneficial precipitation of silicon nitride by critically limiting the contents of harmful impurities, particularly aluminum and vanadium.

The present invention provides a method of manufacturing a grain oriented electromagnetic steel sheet having a high magnetic flux density and a very low iron loss, comprising the steps of reheating a steel slab containing from about 0.030 to 0.095 wt % carbon, from about 1.5 to 7.0 wt % silicon, from about 0.03 to 2.50 wt % manganese, from about 0.003 to 0.040 wt % sulfur and/or selenium, and from 0.0010 to 0.0070 wt % boron at a temperature of over 1,350° C., then hot-rolling the reheated steel slab, subjecting the resulting hot-rolled steel sheet to one or more stages of cold rolling under conditions including a final cold rolling of from about 80 to 95% into a final thickness, conducting primary recrystallization annealing, then coating an annealing separator on the sheet, and applying final annealing, wherein Bi or Ge is added, such element improving fine BN precipitation and improving the texture of primary recrystallized grains of the steel sheet immediately before secondary recrystallization annealing; and wherein N is added in an amount of from 30 to 120 wtppm to the steel slab to precipitate silicon nitride; the aluminum content is controlled to about 0.015 wt % or less and the vanadium content is controlled to about 0.010 wt % or less, as impurities. The important hot rolling conditions include a hot rolling time within a range of from about 50 to 220 seconds, a hot rolling finishing temperature of at least about 850° C., rapid cooling at a cooling rate of at least about 30° C./sec upon completion of hot rolling, and coiling at a temperature of up to about 700° C. Appropriate primary recrystallization conditions and warm rolling are combined to improve the texture.

Bismuth is added in an amount of from about 0.0005 to 0.100 wt %. This has been discovered to accelerate precipitation of fine BN, having a fineness of about 10–500 nm in average diameter in the decarburized sheet, improving the texture of primary recrystallized grains of the steel sheet immediately before subjecting the steel sheet to secondary recrystallization annealing; and primary recrystallization under conditions appropriate for improving the texture, including a heating rate of at least 8° C./sec at a temperature of at least 500° C. in the primary recrystallization annealing, and an annealing temperature of from 800 to 900° C.

We have further provided a method of manufacturing a grain oriented electromagnetic steel sheet having a high magnetic flux density and a very low iron loss, wherein germanium is added in an amount of from about 0.005 to 0.500 wt % as an element accelerating precipitation of fine BN and improving the texture of primary recrystallized grains of the steel sheet immediately before subjecting the steel sheet to a secondary recrystallization annealing. Primary recrystallization conditions appropriate for improving the texture of the material include a heating rate of at least about 5° C./sec at a temperature of at least about 500° C. in the heating step of the first annealing during cold rolling, and an annealing temperature of from about 1,000 to 1,150° C.; the final cold rolling comprises a warm rolling at a maximum temperature within a range of from about 150 to 350° C.

It is desirable also to utilize the addition of a trace element to assist the inhibitor, or a nitriding treatment during the period after decarburization annealing and before the secondary recrystallization. It is also desirable to practice magnetic domain refining, or formation of a tensile film on the steel surface at an appropriate stage.

The final product of the invention is a grain oriented electromagnetic steel sheet having a high magnetic flux density and a very low iron loss, comprising up to about 0.010 wt % carbon, from about 1.5 to 7.0 wt % silicon, from about 0.03 to 2.50 wt % manganese, up to about 0.003 wt % sulfur and/or selenium, from about 0.0004 to 0.0030 wt % boron, and up to about 30 wtppm nitrogen, wherein aluminum is limited to about 0.002 wt % or less, and vanadium is limited to about 0.010 wt % or less, as impurities. An element (Bi or Ge or both) is added for accelerating fine precipitation of BN, thereby improving the texture of primary recrystallized grains of the steel sheet immediately before subjecting the sheet to secondary recrystallization annealing.

A final product of the invention is a grain oriented electromagnetic steel sheet that contains from about 0.005 to 0.100 wt % bismuth and/or from about 0.005 to 0.500 wt % germanium. This accelerates fine precipitation of BN, and improves the texture of primary recrystallized grains of the steel sheet immediately before subjecting the steel sheet to secondary recrystallization annealing.

DESCRIPTION OF THE PREFERRED EMBODIMENTS

Figure 1:
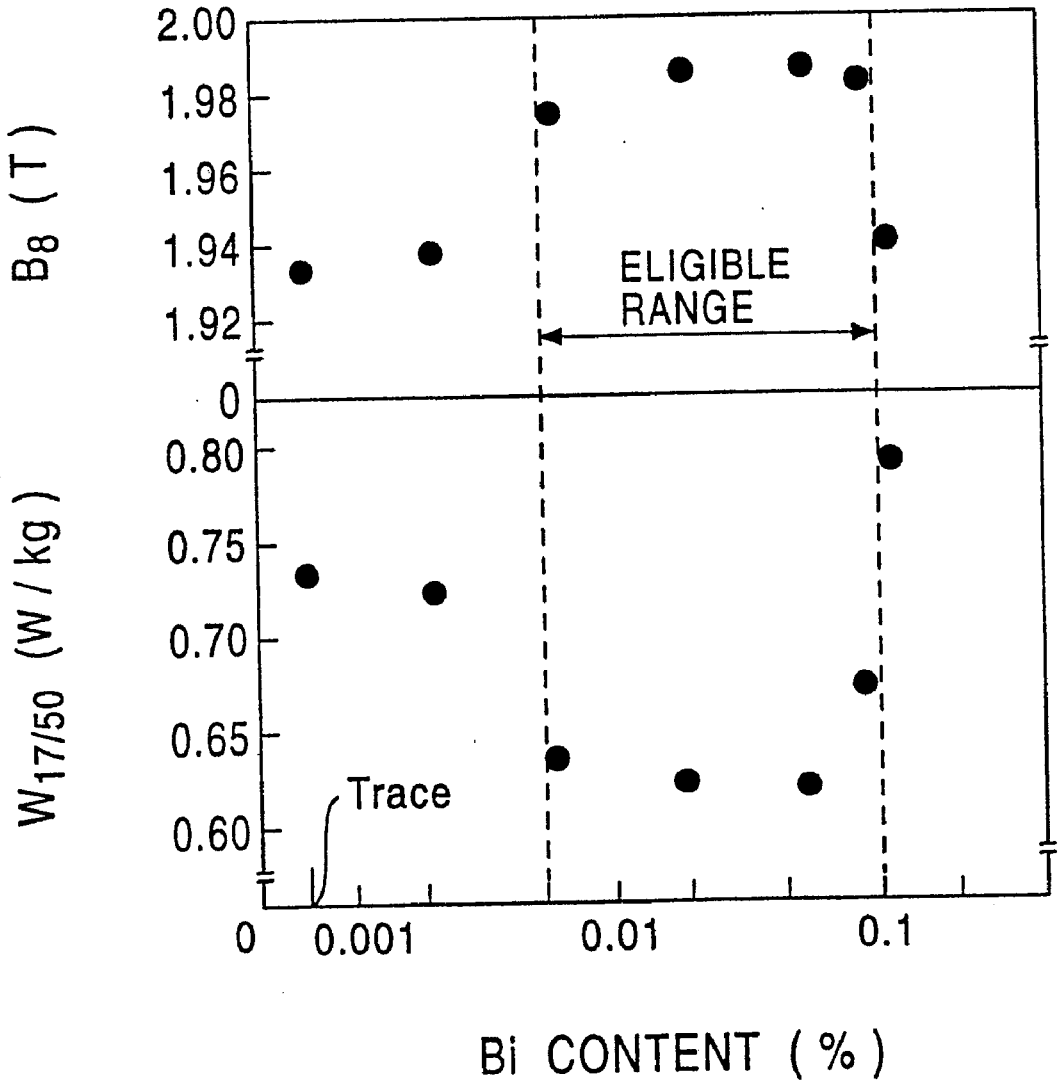
FIG. 1 is a chart which illustrates an important effect of the bismuth content of steel sheet on its magnetic properties.

The progress of development efforts to achievement of the present invention will now be preliminarily described by reference to experiments.

Experiments

Experiment 1: Effects of hot rolling time, hot rolling finishing temperature and intermediate annealing heating rate on magnetic properties in N-containing and Bi-containing steels Two steel slabs each having a thickness of 250 mm (shown for ingot No. 1A in Table 1 which follows) were reheated to 1,410° C., hot-rough-rolled to a thickness of 40 mm, and hot-finishing-rolled with finishing temperatures of 940° C. and 800° C., respectively, into hot-rolled coils having a thickness of 2.4 mm. The hot rolling required 150 seconds from the start of rough rolling up to the end of finishing rolling. A similar hot rolling was applied to two steel slabs represented by ingot Nos. 1B and 1C shown in Table 1 to represent typical conventional chemical compositions of steel. The hot-rolled coils were cooled by jet cooling at a cooling rate within a range of from 45 to 50° C./sec, and then coiled at a temperature of 600° C.

TABLE 1

| INGOT | CHEMICAL COMPOSITION (wt %) *1 | | | | | | | | | |
|---|---|---|---|---|---|---|---|---|---|---|
| NO. | C | Si | Mn | P | Al | S | Se | Sb | Sn | Cr |
| 1A | 0.075 | 3.32 | 0.08 | 0.006 | 0.003 | 0.005 | 0.020 | tr | 0.01 | 0.01 |
| 1B | 0.079 | 3.36 | 0.08 | 0.004 | 0.005 | 0.006 | 0.017 | tr | 0.01 | 0.01 |
| 1C | 0.074 | 3.32 | 0.07 | 0.005 | 0.022 | 0.006 | 0.019 | tr | 0.02 | 0.01 |
| 1D | 0.073 | 3.38 | 0.08 | 0.008 | 0.007 | 0.005 | 0.021 | tr | 0.01 | 0.02 |

| INGOT NO. | CHEMICAL COMPOSITION (wt %) *1 | | | | | | | | WITHIN OR OUT OF RANGE OF INVENTION |
|---|---|---|---|---|---|---|---|---|---|
| | Ni | Cu | Ge | V | Mo | Bi | B (ppm) | N (ppm) | |
| 1A | 0.01 | 0.01 | tr | 0.004 | tr | 0.018 | 25 | 68 | WITHIN |
| 1B | 0.02 | 0.01 | tr | 0.007 | tr | tr | 23 | 81 | OUT |
| 1C | 0.01 | 0.02 | tr | 0.005 | tr | tr | 1.2 | 72 | OUT |
| 1D | 0.01 | 0.01 | tr | tr | tr | 0.024 | 2.3 | 18 | OUT |

*1) FIGS. FOR B AND N ARE IN ppm.

Subsequently, after pickling, the coil was cold-rolled to an intermediate thickness of 1.50 mm and divided into two coils. One of the coils was rapidly heated to 500° C. at a rate of 20° C./sec in an intermediate annealing, further heated at an average heating rate of 10° C./sec in a temperature range of from 500 to 1,050° C., and after a heat treatment at 1,050° C. for 60 seconds, cooled to room temperature in 40 seconds (symbol 1). The other coil was rapidly heated to 500° C. at a rate of 20° C./sec, held at 600° C. to remove rolling oil of the coil, heated to 1,050° C. at an average heating rate of 3.0° C./sec, and after a heat treatment at 1,050° C. for 60 seconds, cooled to room temperature in 40 seconds (symbol 2). After an intermediate annealing, each coil was pickled and rolled by a Sendzimir mill to a thickness of 0.22 mm. The annealed coil was degreased, and subjected to a decarburization annealing serving also as a primary recrystallization annealing at 850° C. for two minutes. In the decarburization annealing, the steel was heated at a rate of 20° C./sec in a temperature range of from 500 to 850° C. Then, MgO containing 5% $TiO_2$ was coated as an annealing separator onto the surface of the annealed coils, and a final annealing was applied. The final annealing comprised heating the coil to 850° C. at a rate of 30° C./h in an atmosphere of 100% $N_2$, holding the same at 850° C. for twenty hours, heating the same to 1,050° C. at a rate of 12° C./h in a mixed atmosphere of 25% $N_2$ and 75% $H_2$, heating the same from 1,050° C. to 1,200° C. in a 100% $H_2$ atmosphere, holding at 1,200° C. for five hours, and then cooling the coil. After cooling, the unreacted annealing separator is removed from the coil surface. An insulating coating agent mainly comprising magnesium phosphate containing 50% colloidal silica was coated onto the coil surface, which was then baked at 800° C. to complete a product. Epstein size (280 mm long×30 mm wide) test pieces were cut from each product along the rolling direction, and after applying stress relieving annealing at 800° C. for three hours, the iron loss $W_{17/50}$ and the magnetic flux density $B_8$ (magnetic flux generated with a magnetic field force of 800 A/m) were measured. These values are comprehensively shown in Table 2 which follows.

TABLE 2

| INGOT NO. | HOT ROLLING FINISHING TEMPERATURE (° C.) | MAGNETIC PROPERTIES: MAGNETIC FLUX DENSITY $B_8$(T) SYMBOL 1 | MAGNETIC FLUX DENSITY $B_8$(T) SYMBOL 2 | IRON LOSS $W_{17/50}$ (W/kg) SYMBOL 1 | IRON LOSS $W_{17/50}$ (W/kg) SYMBOL 2 |
|---|---|---|---|---|---|
| 1A | 800 | 1.913 | 1.895 | 0.964 | 0.984 |
| | 940 | 1.978 | 1.932 | 0.782 | 0.867 |
| 1B | 800 | 1.928 | 1.917 | 0.873 | 0.957 |
| | 940 | 1.930 | 1.925 | 0.870 | 0.934 |

TABLE 2-continued

| INGOT NO. | HOT ROLLING FINISHING TEMPERATURE (° C.) | MAGNETIC PROPERTIES: MAGNETIC FLUX DENSITY $B_8$(T) SYMBOL 1 | MAGNETIC FLUX DENSITY $B_8$(T) SYMBOL 2 | IRON LOSS $W_{17/50}$ (W/kg) SYMBOL 1 | IRON LOSS $W_{17/50}$ (W/kg) SYMBOL 2 |
|---|---|---|---|---|---|
| 1C | 800 | 1.922 | 1.921 | 0.886 | 0.892 |
| | 940 | 1.927 | 1.927 | 0.880 | 0.921 |
| 1D | 800 | 1.925 | 1.922 | 0.867 | 0.889 |
| | 940 | 1.923 | 1.919 | 0.874 | 0.937 |

Table 2 reveals that, while the product prepared from ingot No. 1A with a hot rolling finishing temperature of 940° C. and under intermediate annealing conditions of symbol 1 presents very good iron loss value $W_{17/50}$ and magnetic flux density $B_8$, the iron loss value is low in all the products having conventional chemical compositions (ingot Nos. 1B, 1C and 1D). The final product of ingot 1A had a chemical composition comprising 0.0012 wt % carbon, 3.31 wt % silicon, 0.08 wt % manganese, 0.0005 wt % sulfur, up to 0.0010 wt % selenium, 0.0020 wt % boron, 5 wtppm nitrogen, 0.0005 wt % aluminum, 0.004 wt % vanadium, and 0.0054 wt % bismuth.

Experiment 2: Effects of hot rolling time, hot rolling finishing temperature and intermediate annealing heating rate on magnetic properties in N-containing and Ge-containing steels Two steel slabs having a thickness of 240 mm shown in the line of ingot No. 2A (having a chemical composition within the range of the invention) in Table 3 were reheated to 1,420° C., then rough-rolled into a thickness of 35 mm, and then rolled into hot-rolled coils having a thickness of 2.6 mm through a hot finishing rolling with finishing temperatures of 920° C. and 800° C., respectively. This hot rolling required 150 seconds from the start of rough rolling to the end of finishing rolling. Three steel slabs of ingot Nos. 2B and 2C (conventional chemical composition) and ingot No. 2D (with a low nitrogen content) shown in Table 3 representing the conventional chemical compositions of steel were similarly hot-rolled. After hot rolling, the resultant coils were cooled by water jet cooling at a rate of from 45 to 50° C./sec, and coiled at a temperature of 600° C.

Subsequently, after pickling, the coil was cold-rolled to an intermediate thickness of 1.50 mm and divided into two coils. One of the coils was rapidly heated to 500° C. at a rate of 20° C./sec in an intermediate annealing, further heated at an average heating rate of 12° C./sec in a temperature range of from 500 to 1,100° C., and after a heat treatment at 1,100° C. for 60 seconds, and cooled to room temperature in 40 seconds (symbol 1). The other coil was rapidly heated to 500° C. at a rate of 20° C./sec, held at 600° C. to remove rolling oil of the coil, heated to 1,100° C. at an average heating rate of 3.0° C./sec, and after a heat treatment at 1,100° C. for 60 seconds, cooled to room temperature in 40 seconds (symbol 2). After an intermediate annealing, each coil was pickled and rolled by a Sendzimir mill to a thickness of 0.22 mm through a warm rolling with a maximum sheet temperature of 230° C. The annealed coil was degreased, and subjected to a decarburization annealing serving also as a primary recrystallization annealing at 850° C. for two minutes. Then, MgO containing 5% $TiO_2$ was coated as an annealing separator onto the surface of the annealed coils, and a final annealing was applied. The final annealing comprised heating the coil at 850° C. in an atmosphere of 100% $N_2$, heating the same to 1,050° C. at a rate of 10° C./h in a mixed atmosphere of 25% $N_2$ and 75% $H_2$, heating the same from 1,050° C. to 1,200° C. in a 100% $H_2$ atmosphere, holding at 1,200° C. for five hours, and then cooling the coil. Test pieces were cut from these coils and macro-etched to measure distribution of grain size of the steel sheet. After cooling, the unreacted annealing separator was removed from the coil surfaces, an insulating coating agent mainly comprising magnesium phosphate containing 40% colloidal silica was coated onto the surface and baked at 850° C. to complete the products. The magnetic properties of the products were measured in the same manner as in Experiment 1. These values are comprehensively shown in Table 4 which follows.

TABLE 3

| INGOT NO. | CHEMICAL COMPOSITION (wt %): C | Si | Mn | P | Al | S | Se | Sb | Sn | Cr |
|---|---|---|---|---|---|---|---|---|---|---|
| 2A | 0.078 | 3.35 | 0.08 | 0.005 | 0.004 | 0.005 | 0.019 | tr | 0.01 | 0.01 |
| 2B | 0.072 | 3.31 | 0.08 | 0.006 | 0.006 | 0.006 | 0.018 | tr | 0.01 | 0.02 |
| 2C | 0.076 | 3.23 | 0.07 | 0.005 | 0.024 | 0.006 | 0.020 | tr | 0.02 | 0.01 |
| 2D | 0.075 | 3.34 | 0.08 | 0.008 | 0.006 | 0.005 | 0.021 | tr | 0.01 | 0.02 |

| INGOT NO. | CHEMICAL COMPOSITION (wt %): Ni | Cu | Ge | V | Mo | B (ppm) | N (ppm) | WITHIN OR OUT OF RANGE OF INVENTION |
|---|---|---|---|---|---|---|---|---|
| 2A | 0.01 | 0.01 | 0.025 | 0.005 | tr | 23 | 78 | WITHIN |
| 2B | 0.01 | 0.01 | tr | 0.008 | tr | 21 | 68 | OUT |
| 2C | 0.01 | 0.02 | tr | 0.006 | tr | 1.2 | 75 | OUT |
| 2D | 0.01 | 0.01 | tr | 0.008 | tr | 32 | 22 | OUT |

*) FIGS. FOR B AND N ARE IN ppm.

TABLE 4

| INGOT NO. | HOT ROLLING FINISHING TEMPERATURE (° C.) | MAGNETIC PROPERTIES: MAGNETIC FLUX DENSITY $B_8$(T) SYMBOL 1 | MAGNETIC FLUX DENSITY $B_8$(T) SYMBOL 2 | IRON LOSS $W_{17/50}$ (W/kg) SYMBOL 1 | IRON LOSS $W_{17/50}$ (W/kg) SYMBOL 2 | PRODUCT AVERAGE GRAIN SIZE (mm) SYMBOL 1 | PRODUCT AVERAGE GRAIN SIZE (mm) SYMBOL 2 |
|---|---|---|---|---|---|---|---|
| 2A | 800 | 1.921 | 1.906 | 0.926 | 0.937 | 16.4 | 19.0 |
| | 920 | 1.945 | 1.926 | 0.834 | 0.900 | 6.7 | 12.4 |
| 2B | 800 | 1.894 | 1.887 | 0.952 | 0.965 | 13.4 | 14.8 |
| | 920 | 1.897 | 1.875 | 0.950 | 0.988 | 22.1 | 22.1 |
| 2C | 800 | 1.914 | 1.915 | 0.935 | 0.932 | 27.8 | 28.3 |
| | 920 | 1.923 | 1.917 | 0.903 | 0.928 | 25.6 | 26.3 |
| 2D | 800 | 1.856 | 1.863 | 1.037 | 1.024 | 15.7 | 14.8 |
| | 920 | 1.864 | 1.861 | 1.022 | 1.026 | 17.0 | 14.4 |

As is clear from Table 4, while the product manufactured from ingot No. 2A at a hot rolling finishing temperature of 920° C. under intermediate annealing conditions of symbol 1 gave an excellent iron loss value $W_{17/50}$ and magnetic flux density $B_8$, the products having a conventional chemical composition (ingot No. 2B or 2C) or a low-nitrogen chemical composition (ingot No. 2D) showed an inferior iron loss value in all cases. To judge from the result of macro-etching, deterioration of iron loss in these steel sheets of ingot Nos. 2B, 2C and 2D was apparently caused by coarsening of the grain size, although these steel sheets were subjected to secondary recrystallization. The 2A final product had a chemical composition comprising 0.008 wt % carbon, 3.34 wt % silicon, 0.08 wt % manganese, 0.0005 wt % sulfur, 0.0010 wt % selenium, 0.0018 wt % boron, 4 wtppm nitrogen, 0.0008 wt % aluminum, 0.005 wt % vanadium and 0.025 wt % germanium.

We carried out extensive studies to determine why satisfactory results were obtained in the case of ingot No. 1A at the hot rolling temperature of 940° C. under the intermediate annealing conditions symbol 1, and to determine why satisfactory results were obtained in the case of ingot No. 2A at the hot rolling finishing temperature of 920° C. under the intermediate annealing conditions symbol 1.

We reached the following conclusions:

Nitrogen in the steel served as an inhibitor constituent in ingot Nos. 1A and 2A. Upon rapid cooling after hot rolling, supersaturated nitrogen, present in the steel, was finely precipitated in the form of silicon nitride during the initial stage of the first annealing of cold rolling. During the heating step which follows, silicon nitride converts into (B, Si) N, and is further converted to fine BN, which is precipitated in the steel. Fine BN, having a fineness of about 10–500 nm in average diameter in the decarburized sheet, serves as a powerful inhibitor.

In order to ensure smooth progress of this series of precipitation steps to cause precipitation of fine BN, it is necessary that the steel contains at least about 50 wtppm nitrogen at that time, and further, it is essential to severely limit the contents of nitride forming constituents such as aluminum and vanadium as impurities in the steel, for effective functioning of the solid-solution nitrogen. In other words, in the present invention, fine BN precipitate is created by gradual substitution of B for Si along with heating, of silicon in silicon nitride which was preliminarily finely precipitated at a low temperature in the steel.

Accordingly, we have discovered that it is important to add an element that serves not only for accelerating precipitation of BN but also precipitation of silicon nitride during the process, and of promoting improvement of texture of the primary recrystallized grains of the steel sheet immediately before subjecting the sheet to secondary recrystallization annealing.

With the addition of bismuth, bismuth that is present in the steel causes coarsening of crystal grains after annealing (corresponding to the intermediate annealing in Experiment 1) prior to the final cold rolling. Accordingly, the (110)[001] density of the primary recrystallized grains of the annealing steel sheet, after final cold rolling, increased remarkably. This effect is further accelerated by rapid heating in the primary recrystallization annealing. Bismuth effectively functions as an inhibiting power in the high-temperature region in the final annealing. While silicon nitride cannot display its function as an inhibitor at a temperature higher than 800° C., bismuth serves to inhibit growth of primary recrystallized grains at higher temperatures. Addition of bismuth therefore promotes secondary recrystallization of crystal grains closer to the (110) [001] orientation, under a synergistic effect with BN. We have confirmed that the presence of bismuth improves the texture of primary recrystallized grains to a considerable extent, thereby permitting secondary recrystallization.

When adding germanium, silicon nitride is more finely precipitated during hot rolling, and the synergistic effect of addition of germanium and warm rolling brings about a more desirable texture of primary recrystallized grains after decarburization annealing.

Further, presence of germanium permits achievement of a prescribed improvement of the texture of primary recrystallized grains, thus enabling secondary recrystallization.

According to the secondary recrystallization theory having recently progressed greatly (for example, Hayakawa Y. and Szpunar A.: Acta Metal, 45(1997), pp. 1285–1295), a satisfactory texture of secondary recrystallized grains is available when there are many crystal grains having a large tilting angle of about 20 to 45° as represented by a rotation angle from the (110) [001] orientation as the texture of primary recrystallized grains. The ratio of large tilting grains can be quantitatively evaluated from the value of GA(ω). GA(ω) is derived from the result of measurement of orientation of the primary recrystallized grains as follows. The orientation of individual grains composing the texture of primary recrystallized grains is compared with the orientation after rotation by an angle ω from the (110) [001] orientation (co-orientation). When both orientations overlap each other with a minimum rotation angle θ, this θ is referred to as the rotation angle relative to the ω-orientation of the grains. When measuring the rotation angle θ relative to the ω-orientation of all the grains within the field of view of measurement, and assuming that the total number of the grains is N and the number of grains forming an angle θ within a range of from 20 to 45° to the ω-orientation is n, then, GA(ω) is determined as n/N. That is, when θ for all grains to the ω-orientation is within the range of from 20 to 45°, GA(ω)=1, and superiority of grain growth in the ω-orientation is the highest. When the number of grains having a θ within the range of from 20 to 45° is null, GA(ω)=0, and the quality of ω-orientation growth is the lowest. Placing the origin of ω in the (110) [001] orientation, the texture of primary recrystallized grains of symbol 1 conditions for intermediate annealing in Experiment 2 was evaluated by means of an average (GAAV) of GA(ω) at ω: 0 to 0.14 radian. GAAV was 0.82 for ingot No. 2A, whereas it was 0.76 for ingot No. 2B, 0.74 for ingot No. 2C, and 0.65 for ingot No. 2D. The ingot 2A containing germanium in steel was overwhelmingly favorable. The grain orientation-improving effect of texture of primary recrystallized grains has conventionally been known in the area of warm rolling. In addition, Experiment 2 revealed that addition of germanium permits a high-level improvement of the effect of improving the texture of primary recrystallized grains.

Further, when impurities such as aluminum and vanadium are present, which fix solid-soluted nitrogen in steel in large quantities, a sufficient amount of solid-soluted carbon is unavailable, and this exerts an adverse effect on the texture. Contents of such impurities should therefore be limited accordingly.

Another important point relates to the hot rolling step. In order to increase solid-soluted nitrogen in the steel, it is necessary to keep a high hot rolling finishing temperature, and to limit the hot rolling time within a certain period. It is also necessary to rapidly cool the rolled sheet after completing hot rolling, and to coil it at the lowest possible temperature. Even when applying rapid cooling and coiling at a low temperature, silicon nitride is observed to precipitate to some extent into the steel. Silicon nitride, under these conditions, is very fine and is harmless. If the coil is slowly cooled or wound at a high temperature, coarse silicon nitride would be precipitated in the steel, making it impossible to obtain fine BN precipitates during the cold rolling step, thereby losing a powerful inhibitor function. A longer hot rolling time than a certain period of time leads to precipitation of coarse BN into the steel, thus making it impossible to obtain a fine BN during cold rolling. Further, when many impurities exist such as aluminum and vanadium, fixing solid-soluted nitrogen in the steel, it is impossible to obtain sufficient solid-soluted carbon. It is therefore necessary to control the contents of the impurities aluminum and vanadium.

Yet another point relates to the cold rolling step. In the heating step of the first annealing in cold rolling, fine silicon nitrides precipitates. In order to prevent the precipitated fine silicon nitrides from coarsening, the heating rate should be higher than 5° C./sec within the temperature region over 500° C., which is the precipitation temperature of silicon nitride. If slow heating is effected in this temperature region, coarse silicon nitrides precipitate, resulting in coarsening of (B, Si) N and BN as well, thus preventing the prescribed function as an inhibitor. The temperature for annealing applied first during cold rolling should be higher than 950° C. for addition of bismuth, and higher than 1,000° C. for addition of germanium. Since the finely precipitated BN gradually coarsens at a temperature of over 1,150° C., the upper limit should be about 1,150° C.

When bismuth is added for forming a satisfactory texture, the rolling reduction in the final cold rolling is also an important factor: it should be within a range of from about 80 to 95%. The heating rate at temperatures over about 500° C. of primary recrystallization annealing should be at least about 8° C./sec. That is, a synergistic effect of rapid heating and addition of bismuth permits achievement of improvement of the texture. With a primary recrystallization annealing temperature of under about 800° C., the desired development of the texture of primary recrystallized grains is not observed. When this temperature is above about 900° C., on the other hand, primary recrystallization grains coarsen and cannot impart a sufficient driving force upon secondary recrystallization, thus resulting in defective secondary recrystallization.

When germanium is added for the formation of a satisfactory texture, it is necessary to conduct warm rolling, and the rolling reduction of warm rolling is also an important factor: it is necessary to use a rolling reduction within a range of from about 80 to 95%. The texture improving effect brought about by a combination of these conditions leads to an increase of primary recrystallized grains in the (110) [001] orientation: this takes the form of becoming acute of secondary recrystallization grains which is a favorable result for the purpose of present invention.

Requirements for obtaining the advantages of the invention, and the scope and functions thereof regarding the method of making the grain oriented electromagnetic steel sheet of the invention, will now be described in detail.

First, the ranges of necessary chemical compositions of the steel slab will be described.

C: about 0.010 to 0.095 wt % ("wt %" is hereinafter simply referred to as "%")

A slab carbon content of over about 0.095% causes defective decarburization in the decarburization annealing step, thus leading to deterioration of the magnetic properties. In order to obtain an improved structure by γ-transformation, it is necessary to provide a carbon content of at least about 0.010% in the case of addition of bismuth, and of at least about 0.030% in the case of addition of germanium. A carbon content below the applicable lower limit results in incomplete secondary recrystallization and hence in deterioration of the magnetic properties. The carbon content should therefore be within a range of from about 0.010 to 0.095% (addition of Bi) or from about 0.030 to 0.095% (addition of Ge).

Si: about 1.5 to 7.0%

Silicon is a constituent required for increasing electrical resistance and reducing iron loss, and the silicon content should be at least about 1.5%. A silicon content of over about 7.0%, however, leads to deterioration of workability, thus making it extremely difficult to manufacture or form the desired product. The silicon content should therefore be within a range of from about 1.5 to 7.0%.

Mn: about 0.03 to 2.50%

Manganese is an important constituent because it improves electrical resistance and hot workability. For these purposes, the manganese content should be at least about 0.03%. A manganese content of over about 2.5%, however, induces γ-transformation and causes deterioration of the magnetic property. The manganese content should therefore be within a range of from about 0.03 to 2.5%.

Apart from the foregoing constituents, the steel should contain an inhibitor for inducing secondary recrystallization. In the present invention, the steel contains boron, nitrogen, sulfur and/or selenium as inhibitor constituents.

B: about 0.0010 to 0.0070%

With a boron content of under about 0.0010%, the amount of BN precipitated during the heating step is insufficient during hot-rolled sheet annealing and intermediate annealing. When the boron content is over about 0.0070%, on the other hand, the BN that is precipitated during hot rolling develops a coarsening size. In any such cases, satisfactory secondary recrystallization grains are unavailable. The boron content should therefore be within a range of from about 0.0010 to about 0.0070%.

N: about 30 to about 120 ppm

With a nitrogen content of under about 30 ppm in the slab, the amount of silicon nitride, (B, Si)N and BN is insufficient, when precipitated during the heating step of hot-rolled sheet annealing or intermediate annealing, to obtain satisfactory secondary recrystallization grains. A nitrogen content of over about 120 ppm causes, on the other hand, defects such as blisters. The nitrogen content should therefore be within a range of from about 30 to 120 ppm.

Further, in addition to these inhibitor constituents, it is necessary to add sulfur and/or selenium in a slight amount.

Total content of S and/or Se: about 0.003 to about 0.040%

Sulfur and/or selenium are precipitated in the form of manganese compounds or copper compounds in the steel. These compounds, serving as inhibitors, have a function of precipitation of nuclei of silicon nitride precipitated during the heating step of either hot-rolled sheet annealing or intermediate annealing. In order to cause nucleation so as to ensure production of fine and high-density dispersion silicon nitride, the total amount of these compounds in precipitation suffices to be at least about 0.003%. Even when the content is excessive, the compounds in excess are precipitated separately from BN and serve as inhibitors. However, a content of over about 0.040% causes these compounds to precipitate on grain boundaries and impairs workability during hot rolling. The total content of sulfur and/or selenium should therefore be within a range of from about 0.003 to about 0.040%.

Bismuth or germanium are important for acceleration of fine precipitation of silicon nitride, and improving the texture of primary recrystallized grains.

Bi: about 0.0005 to 0.100%

Addition of bismuth accelerates fine precipitation of silicon nitride, serves to improve the texture of primary recrystallized grains, and is effective for obtaining a very excellent texture. For these purposes, the bismuth content should be at least about 0.0005%. However, a bismuth content of over about 0.100% makes it difficult to conduct cold rolling. The bismuth content should therefore be within a range of from about 0.0005 to 0.100%.

Ge: about 0.005 to 0.500%

Addition of germanium accelerates fine precipitation of silicon nitride, serves to improve the texture of primary recrystallized grains, and gives an excellent texture through a synergistic effect with warm rolling. For these purposes, the germanium content should be at least about 0.005%. However, a germanium content of over about 0.500% makes it difficult to conduct cold rolling. The germanium content should therefore be within a range of from about 0.005 to about 0.500%.

Antimony, tin, tellurium, phosphorus, lead, zinc, indium and chromium (and also bismuth when adding germanium), having a supplementary function of reinforcing the inhibiting power as inhibitors, should preferably be added from time to time to the steel. Among others, antimony, tin, chromium and germanium have favorable functions. It is therefore desirable to add one or more of these elements. For this purpose, the antimony content should preferably be within a range of from about 0.0010 to 0.080%, and the content of tin or chromium within a range of from about 0.0010 to 1.3%. Adding copper or nickel to steel has the effects of promoting an inhibitor and improving the structure, and is therefore useful for furthering the advantages of the invention. For this purpose, each of these constituents should preferably be present in an amount within a range of from about 0.0010 to 1.30%. For the other constituents, a range of from about 0.0010 to about 1.3% is effective.

It is necessary to regulate aluminum to about 0.015% or less, and vanadium to about 0.010% or less because they function as undesirable impurities. These constituents, combining with nitrogen in the steel, reduce the amount of solid-soluted nitrogen effective for generating beneficial silicon nitride. Presence of excessive aluminum and vanadium is detrimental as it results in deterioration of the magnetic properties of the product. Therefore, the aluminum content and the vanadium content should be limited to about 0.015% or less and to about 0.010% or less, respectively.

A grain oriented electromagnetic steel sheet having a chemical composition that is controlled as above can be manufactured by any conventional method. It is the usual practice to prepare a slab having a thickness within a range of from about 200 to 300 mm in the continuous casting process. Even with a thin slab having a thickness of about 30 to 100 mm, the same advantages of the invention are present. In the latter case it is possible to omit a hot rough rolling step.

The steel slab is reheated to a high temperature to achieve solute dissolution of inhibitors in the steel. The slab heating temperature should therefore be at least about 1,350° C. A slab reheating temperature below about 1,350° C. cannot ensure sufficient solute dissolution of the inhibitors. This results in coarse precipitation of BN, and hence in defective secondary recrystallization. Upon hot rolling, it is possible to add known techniques as required, such as thickness reduction or width reducing treatment with a view to achieving a uniform structure before or after slab reheating. Further, when the slab is induction-heated, it is also possible to heat the slab in a very short period of time of about 15 to 30 minutes and to reach a high temperature of at least about 1,400° C.

When carrying out hot rolling, the following conditions are required:

One requirement is to limit the time period from the start to the end of rolling to about 50 to 220 seconds. With a period less than about 50 seconds, precipitation of MnS, MnSe, CuS and CuSe is insufficient, fine precipitation of BN during cold rolling cannot be achieved. A period of over about 220 seconds leads, on the other hand, to coarse precipitation of BN during hot rolling. A powerful inhibitor effect cannot be obtained in any such case.

Another requirement is a hot rolling finishing temperature of at least about 850° C. A hot rolling finishing temperature of less than about 850° C. causes the start of coarse precipitation of silicon nitride and coarse BN in the steel, thus resulting in deterioration of the inhibiting power of the inhibitors.

Yet another requirement is to rapidly cool the sheet at a cooling rate of at least about 30° C./sec after completion of hot rolling. Rapid cooling prevents precipitation of BN and silicon nitride from the over-saturated state, and this improves the driving force for fine precipitation of silicon nitride during the heating step during hot-rolled sheet annealing and intermediate annealing, followed by fine precipitation of (B, Si) N and BN having a fineness of about 10–500 nm in average diameter in the decarburized sheet.

Still another requirement is a coiling temperature of about 700° C. or less. A coiling temperature above about 700° C.

causes coarse precipitation of silicon nitride and BN from the over-saturated state. As a result, the inhibiting power of the inhibitors deteriorates, and the desired magnetic properties become unavailable.

For the cold rolling step, it is possible to adopt any procedure, including single-stage cold rolling after hot-rolled sheet annealing, a two-stage cold rolling method having intermediate annealing in between after hot-rolled sheet annealing, and a two-run cold rolling method having intermediate annealing, in which hot-rolled sheet annealing is omitted or carried out at a lower temperature. A three-stage cold rolling method may also be adopted.

During the heating step of the first annealing (hot-rolled sheet annealing or intermediate annealing) in the cold rolling process, fine precipitation of silicon nitride which is a nucleus of the present invention, and the following precipitation treatment of (B, Si) N followed by that of BN, as the final step, are carried out.

For this purpose, the heating rate in the temperature region above about 500° C. should be at least about 5° C./sec in the first annealing in the cold rolling process, and the annealing temperature must be within a range of from about 1,000 to 1,150° C. With an annealing rate of under about 5° C./sec in the temperature region of over about 500° C., silicon nitride and BN tend toward coarsely precipitating, leading to a decrease in the inhibiting power of the inhibitors. At temperatures of under about 500° C., however, the temperature is so low for the precipitation of silicon nitride or the like that the heating rate has no serious effect on precipitation of the inhibitors. When hot-rolled sheet annealing is to be conducted at a temperature under about 500° C., therefore, this annealing is not deemed the first annealing in the cold rolling process in the present invention. The temperature of the first annealing in the cold rolling process must be at least about 1,000° C., and this temperature converts all fine silicon nitride having precipitated in the initial stage of heating into BN. With a temperature of over about 1,150° C., on the other hand, an Ostwald growth of finely precipitating BN takes place, which coarsens the precipitates and causes deterioration of the inhibiting power of the precipitates.

It is not necessary to impose a particular limitation on the cooling step of such annealing. It is however effective for improving the magnetic properties of the product to perform a rapid cooling treatment for increasing solid-soluted carbon in the steel after annealing, and to carry out a rapid cooling treatment for causing precipitation of fine carbide in the steel, followed by a low temperature maintaining treatment. The rapid cooling treatment as referred to above is a cooling of the steel sheet by spraying a gas and/or a liquid serving as a coolant upon the steel sheet, so as to achieve a cooling rate that is faster than spontaneous cooling: for example, the steel sheet is cooled by spraying $N_2$ gas, water mist or water jet.

Further, decarburizing the surface layer of the steel sheet by increasing the oxidizing ability of the annealing atmosphere is also effective. The preferable range of decarburization in this case is from about 0.005 to 0.0025%. This decarburization treatment causes a decrease in carbon content of the surface layer of the steel sheet, thus reducing the occurrence of γ-transformation upon annealing. As a result, the inhibiting power of the inhibitors in the surface layer in which secondary recrystallization nuclei are generated is strengthened, thereby permitting creation of secondary recrystallization grains of a preferable orientation. In order to obtain this effect, it is recommended to reduce the carbon content of the steel sheet by more than about 0.005%. When reducing the carbon content by over about 0.025%, however, deterioration of the primary recrystallized grain structure occurs.

The rolling reduction of the final cold rolling is preferably within a range of from about 80 to 95%. A rolling reduction of over about 95% makes it difficult to accomplish secondary recrystallization. With a rolling reduction of under about 80%, secondary recrystallized grains of a satisfactory orientation are unavailable. In both cases, the product suffers from deterioration of the magnetic properties.

In the final cold rolling, it is possible to conduct warm rolling or interpass aging. These treatments permit further improvement of the magnetic properties of the steel. It is also desirable to provide linear grooves on the steel sheet surface, serving as known magnetic domain refining means, after final cold rolling.

Primary recrystallization annealing is applied to the steel sheet having a final thickness through the treatments as described above. In the case of a bismuth-containing steel, it is particularly important to control the heating rate of annealing. More specifically, when the heating rate at a temperature of above about 500° C., at which primary recrystallization takes place, is less than about 8° C./second, it becomes difficult to improve the texture of the primary recrystallized grains of the bismuth-containing steel, thus making it impossible for the product to possess both a high magnetic flux density and a low iron loss. It is therefore essential to use a heating rate of at least about 8° C./sec at a temperature of over about 500° C. Further in the bismuth-containing steel, the soaking temperature of primary recrystallization annealing should be within a temperature range of from about 800 to 900° C. Because of a low frequency of nucleation of recrystallization, primary recrystallized grains of the bismuth-containing steel tend become coarse grains, and consequently, the driving force of secondary recrystallization grains tends to decrease. To avoid this inconvenience, the primary recrystallization temperature of the bismuth-containing steel must be up to about 900° C. With a temperature of under about 800° C., on the contrary, it is impossible to obtain a desired primary recrystallization texture with deterioration of the magnetic property. The primary recrystallization temperature should therefore be at least about 800° C. The primary recrystallization annealing can serve also as decarburization annealing. In this case as well, an annealing temperature of under about 800° C. leads to insufficient decarburization, thus making it impossible to reduce the carbon content to below about 0.002%, and hence to obtain satisfactory magnetic properties.

There is no particular limitation on primary recrystallization annealing in the case of addition of germanium, but warm rolling is required.

After primary recrystallization annealing, an annealing separator usually comprising MgO is coated onto the steel sheet surface, and the coated steel sheet is subjected to final annealing. It is desirable for further improving magnetic properties to add a titanium compound to the annealing separator, or to add calcium, boron or chlorine. In the final finishing annealing, secondary recrystallization takes place in the steel sheet, the steel sheet being purified in annealing in a higher temperature region, and desired magnetic properties are achieved.

It is also possible to use an annealing separator which inhibits film formation (blending $Al_2O_3$ or chlorides in the annealing separator). In this case, since formation of a forsterite film usually after final annealing is inhibited, a new tensile film is formed after final annealing. Applicable tensile films include all known films such as ceramic film, vitreous film, a mixture thereof, and metal plating.

It is also possible to apply a nitriding treatment for adding nitrogen in an amount within a range of from about 150 to 250 wtppm into the steel during the period after the primary recrystallization annealing and before the start of secondary recrystallization. For this purpose, a known technique such as heat treatment in an $NH_3$ atmosphere, addition of a nitride to the annealing separator or final annealing in a nitriding atmosphere may be practiced after decarburization annealing.

Further, a known magnetic domain refining treatment for forming a plurality of grooves on the steel sheet surface is applicable during the period after final cold rolling and before final annealing, or after completion of the final annealing.

After the final annealing, an insulating coating is applied as required, and a flattening treatment is applied to complete a product.

In order to reduce the iron loss, linear grooves may be provided after the flattening treatment by using plasma jet irradiaton, linear laser irradiation or protrusive-roll rolling; these represent known magnetic domain refining treatments.

In the final product, the contents of carbon, sulfur, selenium, boron, nitrogen, aluminum and vanadium are considerably reduced as compared to those in the slab, as a result of the purification treatment of the final annealing. However, the contents of silicon, manganese, germanium and bismuth show almost no change from those in the slab. The product therefore comprises up to about 0.010 wt % carbon, from about 1.5 to 7.0 wt % silicon, from about 0.03 to 2.50 wt % manganese, up to about 0.003 wt % in total sulfur or selenium, from about 0.0004 to 0.0030 wt % boron, up to about 30 wtppm nitrogen, up to about 0.002 wt % aluminum and up to about 0.010 wt % vanadium: the elements having functions of accelerating fine precipitation of BN and improving the texture of primary recrystallized grains of the steel sheet immediately before secondary recrystallization annealing are retained in amounts added to the slab. When adding from about 0.005 to 0.5 wt % germanium or from about 0.0005 to 0.100 wt % bismuth to the slab as elements accelerating fine precipitation of BN and improving the texture of primary recrystallized grains of the steel sheet immediately before secondary recrystallization annealing, almost the same contents as in the slab are retained in the product.

EXAMPLES

Example 1

Slabs having a thickness of 250 mm were prepared by continuously casting molten steel having the chemical compositions of ingot Nos. 3A, 3B, 3E, 3F, 3G, 3H and 3I shown in Table 5. After holding the slab at 1,180° C. for three hours, an edging was performed to reduce the slab width by 40 mm, and further the thickness was reduced to 230 mm. The slab was charged in an induction heating furnace and reheated to 1,410° C. in 30 minutes. After soaking for ten minutes, the slab was subjected to hot rolling. The slab was rolled by a rough hot rolling mill into a thickness of 35 mm, and by hot finishing rolling mill into a thickness of 1.8 mm. The hot rolling time was 120 seconds. The hot rolling finishing temperature was within a range of from 930 to 950° C. After the end of hot rolling, the hot-rolled sheet was rapidly cooled by spraying a water jet at a cooling rate within a range of from 55 to 65° C./sec, and coiled at a temperature of 600 to 630° C.

TABLE 5

| INGOT | CHEMICAL COMPOSITION (wt %) | | | | | | | | | |
|---|---|---|---|---|---|---|---|---|---|---|
| NO. | C | Si | Mn | P | Al | S | Se | Sb | Sn | Cr |
| 3A | 0.075 | 3.32 | 0.08 | 0.006 | 0.003 | 0.005 | 0.020 | tr | 0.01 | 0.01 |
| 3B | 0.079 | 3.36 | 0.08 | 0.004 | 0.005 | 0.006 | 0.017 | tr | 0.01 | 0.01 |
| 3C | 0.074 | 3.32 | 0.07 | 0.005 | 0.022 | 0.006 | 0.019 | tr | 0.02 | 0.01 |
| 3D | 0.073 | 3.38 | 0.08 | 0.008 | 0.007 | 0.005 | 0.021 | tr | 0.01 | 0.02 |
| 3E | 0.069 | 3.36 | 0.07 | 0.004 | 0.006 | 0.003 | 0.018 | tr | 0.02 | 0.01 |
| 3F | 0.074 | 3.35 | 0.08 | 0.006 | 0.007 | 0.005 | 0.020 | tr | 0.01 | 0.01 |
| 3G | 0.083 | 3.28 | 0.07 | 0.004 | 0.009 | 0.003 | 0.019 | tr | 0.02 | 0.01 |
| 3H | 0.068 | 3.36 | 0.07 | 0.038 | 0.007 | 0.004 | 0.018 | tr | 0.01 | 0.01 |
| 3I | 0.069 | 3.35 | 0.07 | 0.012 | 0.009 | 0.006 | 0.019 | tr | 0.02 | 0.01 |
| 3J | 0.074 | 3.32 | 0.07 | 0.005 | 0.006 | 0.007 | 0.021 | 0.011 | 0.02 | 0.02 |
| 3K | 0.077 | 3.33 | 0.07 | 0.003 | 0.005 | 0.008 | 0.016 | 0.022 | 0.01 | 0.01 |
| 3L | 0.072 | 3.38 | 0.07 | 0.025 | 0.003 | 0.005 | 0.018 | 0.048 | 0.01 | 0.02 |
| 3M | 0.079 | 3.37 | 0.07 | 0.005 | 0.007 | 0.007 | 0.018 | 0.032 | 0.02 | 0.01 |
| 3N | 0.085 | 3.26 | 0.08 | 0.013 | 0.011 | 0.013 | tr | tr | 0.13 | 0.21 |
| 3O | 0.068 | 3.42 | 0.07 | 0.005 | 0.008 | 0.016 | tr | 0.025 | 0.01 | 0.01 |
| 3P | 0.072 | 3.32 | 0.08 | 0.003 | 0.008 | 0.006 | 0.020 | tr | 0.21 | 0.42 |
| 3Q | 0.074 | 3.32 | 0.08 | 0.007 | 0.007 | 0.018 | tr | tr | 0.02 | 0.11 |
| 3R | 0.068 | 3.36 | 0.08 | 0.008 | 0.004 | 0.024 | tr | tr | 0.02 | 0.01 |

| INGOT NO. | CHEMICAL COMPOSITION (wt %) | | | | | | | | WITHIN OR OUT OF RANGE OF INVENTION |
|---|---|---|---|---|---|---|---|---|---|
| | Ni | Cu | Ge | V | Mo | Bi | B (ppm) | N (ppm) | |
| 3A | 0.01 | 0.01 | tr | 0.004 | tr | 0.018 | 25 | 68 | WITHIN |
| 3B | 0.02 | 0.01 | tr | 0.007 | tr | tr | 23 | 81 | OUT |
| 3C | 0.01 | 0.02 | tr | 0.005 | tr | tr | 1.2 | 72 | OUT |
| 3D | 0.01 | 0.01 | tr | tr | tr | 0.024 | 2.3 | 18 | OUT |
| 3E | 0.01 | 0.01 | tr | tr | tr | 0.002 | 26 | 68 | OUT |
| 3F | 0.01 | 0.01 | tr | 0.002 | tr | 0.006 | 39 | 69 | WITHIN |
| 3G | tr | 0.01 | tr | 0.006 | tr | 0.054 | 35 | 82 | WITHIN |

TABLE 5-continued

| | | | | | | | | | |
|---|---|---|---|---|---|---|---|---|---|
| 3H | 0.01 | 0.01 | tr | 0.006 | tr | 0.089 | 44 | 79 | WITHIN |
| 3I | tr | 0.01 | tr | tr | tr | 0.120 | 28 | 82 | OUT |
| 3J | tr | 0.01 | tr | 0.006 | tr | 0.026 | 34 | 76 | WITHIN |
| 3K | tr | 0.01 | tr | 0.006 | tr | 0.034 | 43 | 85 | WITHIN |
| 3L | 0.25 | 0.02 | 0.029 | 0.007 | tr | 0.048 | 26 | 84 | WITHIN |
| 3M | tr | 0.01 | 0.035 | 0.002 | 0.010 | 0.022 | 18 | 80 | WITHIN |
| 3N | tr | 0.15 | tr | tr | 0.010 | 0.052 | 25 | 72 | WITHIN |
| 3O | 0.35 | 0.28 | tr | 0.007 | 0.012 | 0.062 | 41 | 75 | WITHIN |
| 3P | 0.20 | 0.02 | tr | 0.006 | tr | 0.020 | 27 | 66 | WITHIN |
| 3Q | 0.15 | 0.22 | 0.019 | 0.002 | tr | 0.035 | 19 | 68 | WITHIN |
| 3R | 0.05 | 0.08 | tr | tr | tr | 0.027 | 34 | 74 | WITHIN |

*) FIGS. FOR B AND N ARE IN ppm.

Further, each coil was subjected to hot-band annealing at 1,100° C. for 40 seconds. In this hot-band annealing, the sheet was preheated to 300° C., heated to 500° C. in 15 seconds, further heated to 1,100° C. at a rate of 12° C./sec, soaked, and then rapidly cooled with water mist at a cooling rate of 35° C./sec. The annealing atmosphere was a mixed atmosphere of 50% $N_2$ and 50% $H_2$ having a dew point of 55° C., and carbon in an amount of 0.012% was eliminated from the surface layer of the steel sheet.

Subsequently, each coil was pickled and rolled into a final thickness of 0.22 mm through warm rolling in which the exit temperature of rolling pass was within a range of from 170 to 250° C. and two or more passes exceeded 220° C. by a Sendzimir mill. After degreasing, the cold-rolled sheet was subjected to decarburization annealing at 850° C. for two minutes. For the temperature range of from 500 to 850° C. in decarburization annealing, the heating rate was 20° C./sec. An annealing separator mainly comprising MgO and containing 5% $TiO_2$ was coated onto the surface of the annealed sheet surface, and then, the sheet was subjected to final annealing. The final annealing was applied in a 100% $N_2$ atmosphere during the heating step to 850° C., in a mixed atmosphere of 25% $N_2$ and 75% $H_2$ during heating from 850 to 1,150° C., and in a 100% $H_2$ atmosphere within a temperature range of from 1,150 to 1,200° C. and for holding at 1,200° C. for five hours. The unreated annealing separator was removed from the surface of the annealed sheet. An insulating coating agent mainly comprising magnesium phosphate containing 50% colloidal silica was coated onto the coil surface, and baked at 850° C. Subsequently, a plasma jet was linearly irradiated onto the steel sheet surface at the rolling direction intervals of 5 mm to complete a product.

An SST test piece having a width of 100 mm and a length of 400 mm was cut from each product in the rolling direction to measure the iron loss $W_{17/50}$ and the magnetic flux density $B_8$. Measured values relative to the bismuth content are comprehensively shown in FIG. 1. As shown in FIG. 1, the grain oriented electromagnetic steel sheets manufactured by using ingots 3A, 3F, 3G and 3H having appropriate bismuth contents of the invention had a high magnetic flux density and a low iron loss. The final products of 3A, 3F, 3G and 3H contained from 0.0007 to 0.0018 wt % carbon, from 3.26 to 3.36 wt % silicon, from 0.0007 to 0.0018 wt % manganese, from 0.0005 to 0.0012 wt % sulfur, from 0.0005 to 0.0015 wt % selenium, from 0.0012 to 0.0028 wt % boron, from 4 to 10 wtppm nitrogen, from 0.0005 to 0.0018 wt % aluminum, from 0.002 to 0.006 wt % vanadium, and from 0.0009 to 0.0043 wt % bismuth.

Example 2

Slabs having a thickness of 220 mm were prepared by continuously casting, while applying electromagnetic stirring, molten steel having the chemical compositions of ingot Nos. 3J and 3K shown in Table 5. Upon melting the ingots, the aluminum content was varied within a range of from 0.001 to 0.032 for ingot No. 3J and the vanadium content was varied within a range of from 0.003 to 0.0025% for ingot No. 3K by changing the extent of purifying treatment of impurities. Each slab was charged in an induction heating furnace and reheated to 1,390° C. in an hour. After soaking for 10 minutes, the slab was subjected to hot rolling. The slab was rolled by a hot rough rolling mill into a thickness of 45 mm, and by hot finishing rolling mill into a thickness of 2.0 mm. The hot rolling time was within a range of from 120 to 140 seconds. The hot rolling finishing temperature was within a range of from 970 to 990° C. After the end of hot rolling, the hot-rolled sheet was rapidly cooled at a cooling rate within a range of from 65 to 70° C./sec, and coiled at a temperature of 550 to 620° C. Further, each coil was subjected to hot-band annealing at 1,100° C. for 30 seconds. In this hot-band annealing, the sheet was preheated to 200° C., heated to 500° C. in 15 seconds, further heated to 1,100° C. at a rate of 15° C./sec, soaked, and then rapidly cooled by spraying water mist. The annealing atmosphere comprised a fuel gas having an air/fuel ratio of 0.95 and a dew point of 45° C., and carbon in an amount of 0.0020% was eliminated from the surface layer of the steel sheet. Subsequently, each coil was pickled and rolled into a final thickness of 0.34 mm through warm rolling in which the maximum stand exit temperature was within a range of from 150 to 230° C. and an interpass aging treatment was applied for 10 to 40 minutes. After degreasing, the cold-rolled sheet was subjected to decarburization annealing at 820° C. for two minutes. For the temperature range of from 500 to 820° C. in decarburization annealing, the heating rate was 14° C./sec. An annealing separator mainly comprising MgO and containing 7% $TiO_2$ and 2% strontium sulfate was coated onto the surface of the annealed sheet surface, and then, the sheet was subjected to final annealing. The final annealing was applied at a heating rate of 35° C./hour, in a 100% $N_2$ atmosphere during the heating step to 900° C., in a mixed atmosphere of 30% $N_2$ and 70% $H_2$ during heating from 900 to 1,150° C., and in a 100% $H_2$ atmosphere within a temperature range of from 1,150 to 1.180° C. and for holding at 1,180° C. for five hours. The unreacted annealing separator was removed from the surface of the annealed sheet. An insulating coating agent mainly comprising aluminum phosphate containing 60% colloidal silica was coated onto the coil surface, and baked at 800° C. to complete a product.

Figure 2:
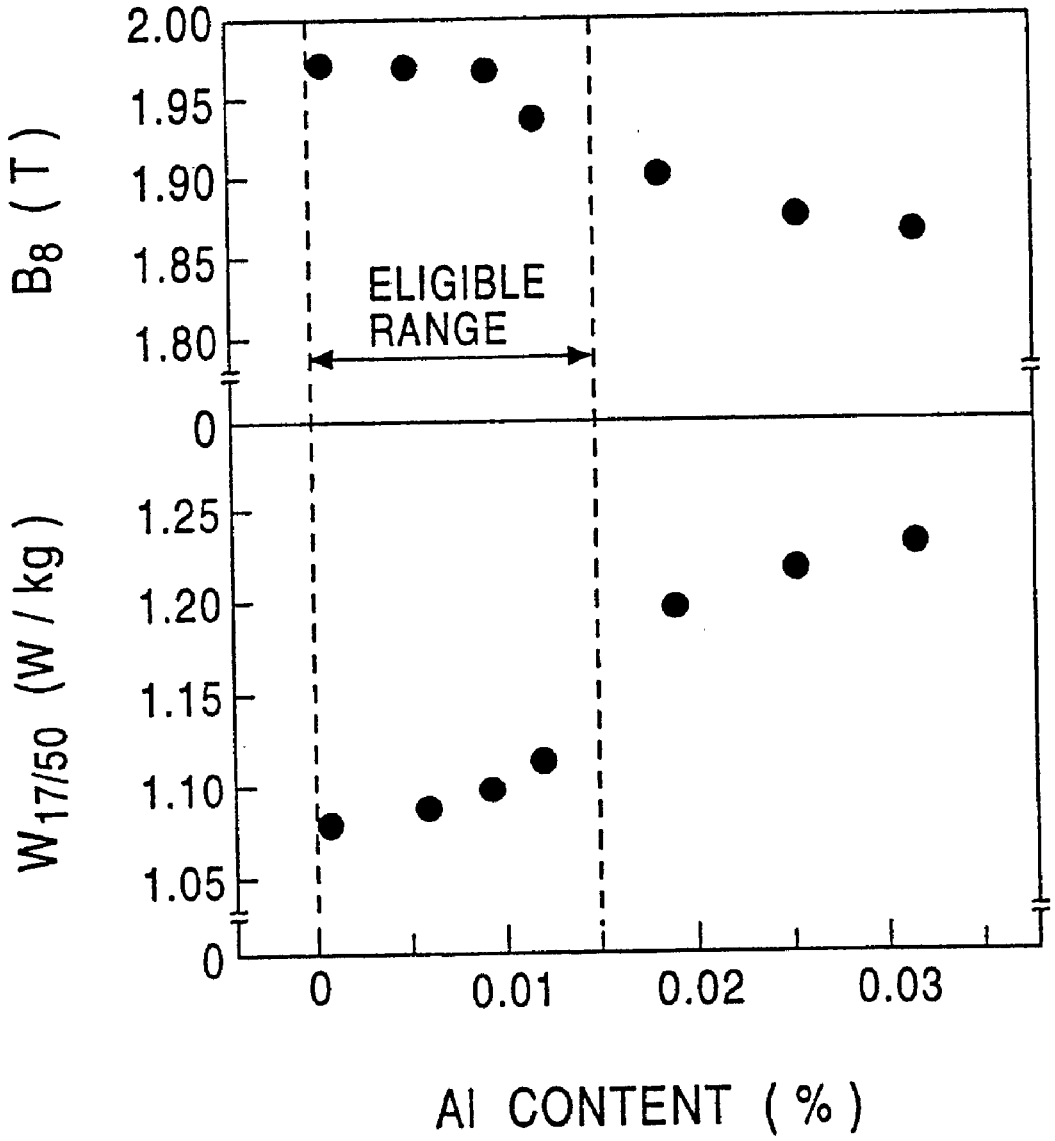
FIG. 2 is a chart which illustrates the effect of aluminum content as an impurity in steel sheet, showing its effect on the magnetic properties in a bismuth-containing steel sheet.
Figure 3:
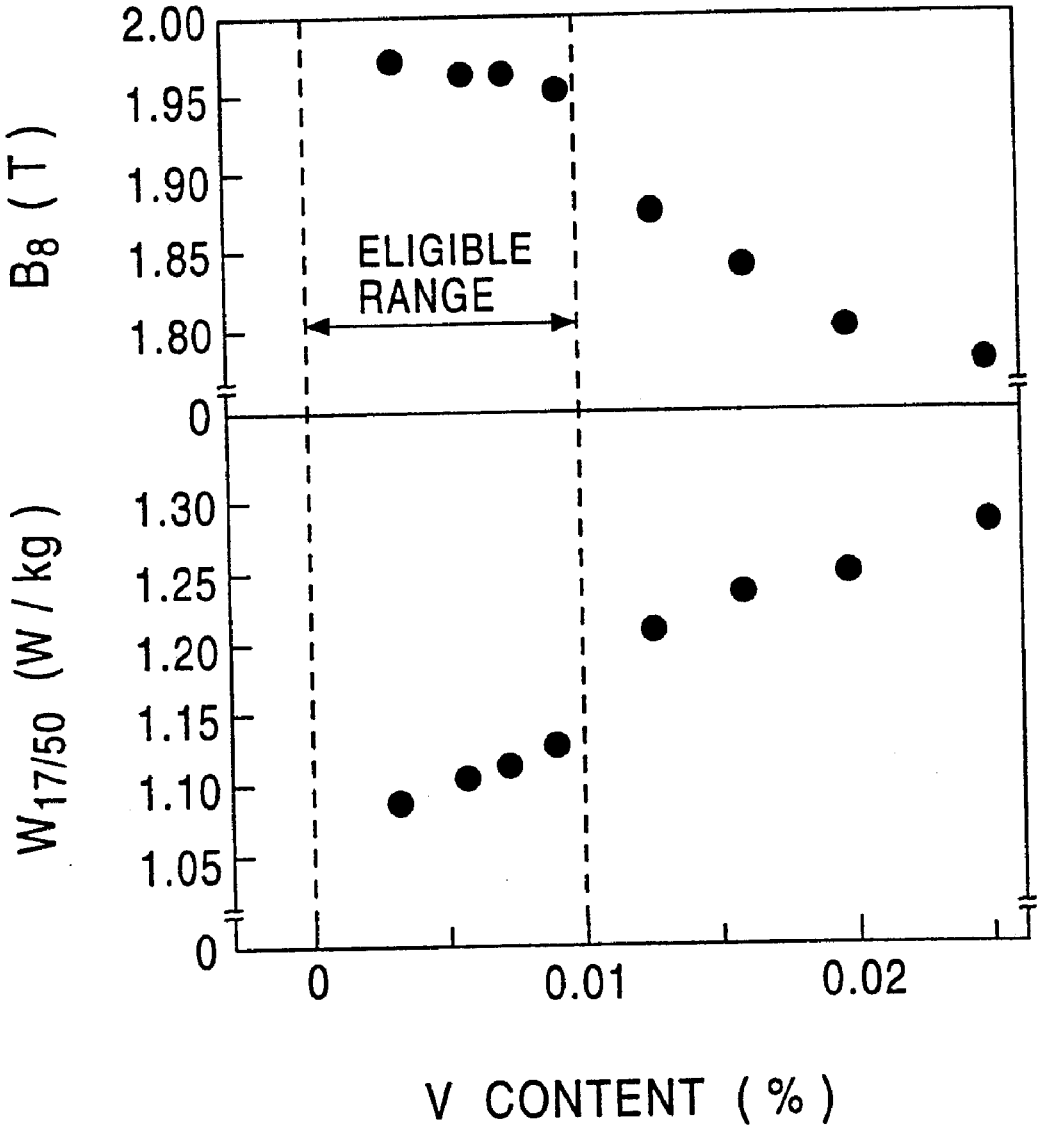
FIG. 3 is a chart which illustrates the comparable effect of vanadium content as indicated in Example 2.

Epstein size (280 mm×30 mm) test pieces were cut in the rolling direction from each product, and after subjecting to stress relieving annealing at 800° C. for three hours, the iron loss value $W_{17/50}$ and the magnetic flux density $B_8$ were measured. The results are shown in FIGS. 2 and 3. FIGS. 2 and 3 indicate that it is necessary to regulate the aluminum content to 0.015% or less, and the vanadium content to 0.010% or less, as impurities.

Example 3

Six steel slabs having chemical compositions of ingot Nos. 3L, 3M and 3N and having a thickness of 70 mm were melted. These slabs were charged into an electric heating furnace, reheated to 1,350° C., and hot-rolled by a hot finishing rolling mill into hot-rolled coils having a thickness of 2.4 mm. For the six coils of ingot No. 3L, the hot rolling time was varied to 22, 43, 53, 126, 225 and 365 seconds by altering the rolling speed. The hot rolling finishing temperature was within a range of from 900 to 950° C. After the end of hot rolling, the hot-rolled sheet was rapidly cooled at a cooling rate within a range of from 45 to 50° C./sec, and coiled at 650° C. For the six coils of ingot No. 3M, the hot rolling time was for 160 seconds. The hot rolling finishing temperature was varied to 1,050° C., 1,000° C., 930° C., 870° C., 840° C. and 810° C. by changing the amount of roll coolant water. After hot rolling, the hot-rolled sheet was water-cooled at a cooling rate within a range of from 38 to 45° C./sec, and coiled at 550 to 620° C. into a hot-rolled coil. For all the six coils of ingot No. 3N, the hot rolling time was 160 seconds, and the hot rolling finishing temperature was within a range of from 980 to 1,000° C. After the end of hot rolling, the hot-rolled sheet was rapidly cooled at a cooling rate within a range of from 45 to 67° C./sec, and coiled at 640 to 660° C.

Each of these coils was annealed at 500° C., pickled, and cold rolled by a tandem mill into a thickness of 1.80 mm. The cold-rolled sheet was subjected to intermediate annealing. Intermediate annealing comprised a heat treatment consisting of heating to 500° C. at a heating rate of 20° C./sec, heating from 500 to 1,030° C. at a heating rate of 12° C./sec, holding at 1,030° C. for 60 seconds, and cooling by spraying water jet in 30 seconds. Subsequently, each coil was pickled and rolled into a final thickness of 0.26 mm by a Sendzimir mill. After degreasing, grooves having a depth of 20 $\mu$m and a width of 120 $\mu$m extending in direction perpendicular to the rolling direction were repeatedly formed at intervals of 5 mm in parallel with the rolling direction by electrolytic etching on the steel sheet surface. Then, decarburization annealing was applied at 820° C. for two minutes. For the six coils of ingot Nos. 3L and 3N, heating from 500 to 820° C. was conducted at a heating rate of 17° C./sec. For the six coils of ingot No. 3N, the heating rate from 500 to 820° C. was varied to 4.0, 6.2, 8.5, 16.5, 20 and 35° C./sec. Subsequently, the nitrogen content in the steel was increased to 120 to 150 ppm through a nitriding treatment at 800° C. for 30 seconds in an atmosphere comprising 10% $NH_3$, 70% $N_2$ and 20% $H_2$. An annealing separator agent mainly comprising MgO and containing 7% $TiO_2$ and 2% tin oxide was coated onto the surface of the annealed sheet surface, and then, the sheet was subjected to final annealing. The final annealing was applied at a heating rate of 35° C./hour in a 100% $N_2$ atmosphere during heating to 950° C., in a mixed atmosphere of 35% $N_2$ and 65% $H_2$ during heating from 950 to 1,180° C., and in a 100% $H_2$ atmosphere for holding at 1,180° C. for five hours. The unreacted annealing separator was removed from the surface of the annealed sheet. An insulating coating agent mainly comprising magnesium phosphate containing 60% colloidal silica was coated onto the coil surface, and baked at 800° C. to complete a product.

Epstein size (280 mm×30 mm) test pieces were cut in the rolling direction from each product, and after subjecting to stress relieving annealing at 800° C. for three hours, the iron loss value $W_{17/50}$ and the magnetic flux density $B_8$ were measured. The results are shown in Tables 6, 7 and 8. These Tables show that, in the products satisfying the manufacturing conditions of the invention, both a high magnetic flux density and a low iron loss are present.

TABLE 6

| INGOT NO. | HOT ROLLING TIME (s) | MAGNETIC PROPERTIES $B_8$ (T) | MAGNETIC PROPERTIES $W_{17/50}$ (W/kg) | ELIGIBLE OR NOT |
|---|---|---|---|---|
| 3L | 22 | 1.905 | 0.858 | NO |
| | 43 | 1.916 | 0.830 | NO |
| | 52 | 1.949 | 0.742 | YES |
| | 126 | 1.957 | 0.723 | YES |
| | 225 | 1.954 | 0.736 | YES |
| | 365 | 1.897 | 0.923 | NO |

TABLE 7

| INGOT NO. | HOT ROLLING FINISHING TEMPERATURE (° C.) | MAGNETIC PROPERTIES $B_8$ (T) | MAGNETIC PROPERTIES $W_{17/50}$ (W/kg) | ELIGIBLE OR NOT |
|---|---|---|---|---|
| 3M | 1050 | 1.950 | 0.746 | YES |
| | 1000 | 1.958 | 0.724 | YES |
| | 930 | 1.953 | 0.736 | YES |
| | 870 | 1.947 | 0.742 | YES |
| | 840 | 1.908 | 0.854 | NO |
| | 810 | 1.893 | 0.931 | NO |

TABLE 8

| INGOT NO. | DECARBURIZATION ANNEALING HEATING RATE (° C./s) | MAGNETIC PROPERTIES $B_8$ (T) | MAGNETIC PROPERTIES $W_{17/50}$ (W/kg) | ELIGIBLE OR NOT |
|---|---|---|---|---|
| 3N | 4.0 | 1.887 | 0.895 | NO |
| | 6.2 | 1.911 | 0.832 | NO |
| | 8.5 | 1.945 | 0.748 | YES |
| | 16.5 | 1.948 | 0.742 | YES |
| | 20 | 1.958 | 0.724 | YES |
| | 35 | 1.954 | 0.733 | YES |

Example 4

Each one slab having any of the chemical compositions of ingot Nos. 3A to 3R shown in Table 5 was cast into a slab having a thickness of 240 mm while applying electromagnetic stirring. Each slab was heated to 1,220° C. in a gas heating furnace, and then, charged into an induction heating furnace to reheat to 1,430° C. by slow heating for two hours. The heated slab was then subjected to hot rolling. A hot-rolled coil having a thickness of 2.0 mm was prepared through hot roughing and hot finishing rolling. The hot rolling time was 180 seconds, and the hot rolling finishing temperature was within a range of from 950 to 980° C. After the end of hot rolling, the sheet was cooled at a cooling rate of 55° C./sec and coiled at 580° C. After pickling, the coil was rolled by a 4-stand tandem mill into an intermediate thickness of 1.40 mm, and then subjected to intermediate annealing. The intermediate annealing comprised heating to 500° C. at a heating rate of 14° C./sec, and after soaking at 1,100° C. for 40 seconds, rapidly cooling by spraying a water jet at a cooling rate of 35° C./sec. The annealing atmosphere was a decarburizative having a dew point of 50° C. and comprising 70% $H_2$ and 30% $N_2$, to reduce the carbon content by 0.015% from the surface layer of the steel sheet. After pickling the annealed sheet, it was subjected to warm rolling in which the sheet had a maximum temperature within a range of from 220 to 280° C. at roll bite exit on the exit sides of the third and fourth stands, into a final thickness of 0.19 mm. After degreasing, the cold-rolled sheet was subjected to decarburization annealing at 850° C. for two minutes. The heating rate from 500 to 850° C. in decarburization annealing was 14° C./sec. An annealing separator agent mainly comprising MgO and containing 6% $TiO_2$ and strontium hydroxide was coated onto the surface of the annealed sheet, and then, the sheet was subjected to final annealing. The final annealing was applied in a 100% $H_2$ atmosphere during the heating to 850° C. at a heating rate of 35° C./hour, then holding at 850° C. for 25 hours, in a mixed atmosphere of 20% $N_2$ and 80% $H_2$ during heating from 850 to 1,100° C., and in a 100% $H_2$ atmosphere during heating from 1,100 to 1,180° C. and for holding at 1,180° C. for five hours. The unreacted annealing separator was removed from the surface of the annealed sheet. An insulating coating agent mainly comprising magnesium phosphate containing 60% colloidal silica was coated onto the coil surface, and baked at 800° C. Subsequently, a plasma jet was linearly irradiated onto the steel sheet surface at the rolling direction intervals of 5 mm to complete a product.

SST test pieces having a width of 100 mm and a length of 400 mm were cut from each product in the rolling direction to measure the iron loss $W_{17/50}$ and the magnetic flux density $B_8$. The result of measurement is shown in Table 9. Table 9 reveals that the product within the ranges of chemical composition of the invention had a high magnetic flux density and a low iron loss.

TABLE 9

| INGOT NO. | MAGNETIC PROPERTIES $B_8$(T) | MAGNETIC PROPERTIES $W_{17/50}$ (W/kg) | BN PARTICLE FINENESS (AVERAGE DIAMETER SIZE; nm) | REMARKS |
|---|---|---|---|---|
| 3A | 1.980 | 0.612 | 31 | EXAMPLE OF THE INVENTION |
| 3B | 1.925 | 0.768 | 682 | COMPARATIVE EXAMPLE |
| 3C | 1.927 | 0.753 | 15 | COMPARATIVE EXAMPLE |
| 3D | 1.902 | 0.856 | 26 | COMPARATIVE EXAMPLE |
| 3E | 1.928 | 0.750 | 578 | COMPARATIVE EXAMPLE |
| 3F | 1.972 | 0.626 | 113 | EXAMPLE OF THE INVENTION |
| 3G | 1.988 | 0.593 | 24 | EXAMPLE OF THE INVENTION |
| 3H | 1.984 | 0.602 | 13 | EXAMPLE OF THE INVENTION |
| 3I | 1.974 | 0.623 | 10 | COMPARATIVE EXAMPLE |
| 3J | 1.981 | 0.607 | 23 | EXAMPLE OF THE INVENTION |
| 3K | 1.983 | 0.602 | 28 | EXAMPLE OF THE INVENTION |
| 3L | 1.989 | 0.589 | 15 | EXAMPLE OF THE INVENTION |
| 3M | 1.979 | 0.611 | 19 | EXAMPLE OF THE INVENTION |
| 3N | 1.975 | 0.620 | 24 | EXAMPLE OF THE INVENTION |
| 3O | 1.985 | 0.601 | 22 | EXAMPLE OF THE INVENTION |
| 3P | 1.982 | 0.606 | 2 | EXAMPLE OF THE INVENTION |
| 3Q | 1.974 | 0.622 | 28 | EXAMPLE OF THE INVENTION |
| 3R | 1.978 | 0.613 | 34 | EXAMPLE OF THE INVENTION |

Example 5

Slabs having a thickness of 240 mm were prepared by continuously casting molten steel having chemical compositions of ingot Nos. 4A, 4B, 4E, 4F, 4G, 4H, 4I and 4J shown in Table 10. After holding at 1,220° C. for three hours, each slab was subjected to edging to reduce the slab width by 40 mm, and further, the thickness was reduced to 200 mm. The slab was charged in an induction heating furnace and reheated to 1,410° C. in 30 minutes. After soaking for ten minutes, the slab was subjected to hot rolling. The slab was rolled by hot rough rolling mill into a thickness of 35 mm, and by hot finishing rolling mill into a thickness of 2.2 mm. The hot rolling time was 150 seconds. The hot rolling finishing temperature was within a range of from 930 to 950° C. After the end of hot rolling, the hot-rolled sheet was rapidly cooled by spraying a water jet at a cooling rate within a range of 40 to 55° C./sec, and coiled at a temperature of 600 to 630° C.

TABLE 10

| INGOT NO. | CHEMICAL COMPOSITION (wt %) C | Si | Mn | P | Al | S | Se | Sb | Sn | Cr |
|---|---|---|---|---|---|---|---|---|---|---|
| 4A | 0.078 | 3.35 | 0.08 | 0.005 | 0.004 | 0.005 | 0.019 | tr | 0.01 | 0.01 |
| 4B | 0.072 | 3.31 | 0.08 | 0.006 | 0.006 | 0.006 | 0.018 | tr | 0.01 | 0.02 |
| 4C | 0.076 | 3.23 | 0.07 | 0.005 | 0.024 | 0.006 | 0.020 | tr | 0.02 | 0.01 |
| 4D | 0.075 | 3.34 | 0.08 | 0.008 | 0.006 | 0.005 | 0.021 | tr | 0.01 | 0.02 |
| 4E | 0.062 | 3.28 | 0.07 | 0.004 | 0.003 | 0.003 | 0.018 | tr | 0.02 | 0.01 |
| 4F | 0.087 | 3.42 | 0.08 | 0.008 | 0.007 | 0.005 | 0.020 | tr | 0.01 | 0.01 |
| 4G | 0.076 | 3.22 | 0.07 | 0.004 | 0.005 | 0.003 | 0.019 | tr | 0.02 | 0.01 |
| 4H | 0.068 | 3.34 | 0.07 | 0.012 | 0.007 | 0.007 | 0.021 | tr | 0.01 | 0.01 |
| 4I | 0.078 | 3.28 | 0.08 | 0.003 | 0.009 | 0.008 | 0.018 | tr | 0.02 | 0.01 |
| 4J | 0.084 | 3.34 | 0.07 | 0.009 | 0.006 | 0.004 | 0.020 | tr | 0.01 | 0.02 |
| 4K | 0.086 | 3.24 | 0.07 | 0.045 | 0.006 | 0.008 | 0.016 | 0.034 | 0.01 | 0.01 |
| 4L | 0.074 | 3.34 | 0.08 | 0.025 | 0.008 | 0.024 | tr | tr | 0.13 | 0.38 |
| 4M | 0.075 | 3.32 | 0.07 | 0.008 | 0.007 | 0.005 | 0.018 | 0.028 | 0.21 | 0.01 |
| 4N | 0.082 | 3.34 | 0.08 | 0.015 | 0.011 | 0.014 | tr | tr | 0.02 | 0.25 |
| 4O | 0.067 | 3.36 | 0.07 | 0.005 | 0.008 | 0.015 | tr | 0.027 | 0.01 | 0.01 |
| 4P | 0.075 | 3.38 | 0.07 | 0.003 | 0.004 | 0.006 | 0.019 | tr | 0.02 | 0.02 |
| 4Q | 0.073 | 3.35 | 0.08 | 0.006 | 0.007 | 0.018 | tr | 0.020 | 0.02 | 0.11 |
| 4R | 0.065 | 3.32 | 0.07 | 0.005 | 0.009 | 0.007 | tr | 0.013 | 0.02 | 0.01 |

| INGOT NO. | CHEMICAL COMPOSITION (wt %) *1 Ni | Cu | Ge | V | Mo | B (ppm) | N (ppm) | WITHIN OR OUT OF RANGE OF INVENTION |
|---|---|---|---|---|---|---|---|---|
| 4A | 0.01 | 0.01 | 0.025 | 0.005 | tr | 23 | 78 | WITHIN |
| 4B | 0.01 | 0.01 | tr | 0.008 | tr | 21 | 68 | OUT |
| 4C | 0.01 | 0.02 | tr | 0.006 | tr | 1.2 | 75 | OUT |
| 4D | 0.01 | 0.01 | tr | 0.008 | tr | 32 | 22 | OUT |
| 4E | 0.01 | 0.01 | 0.002 | 0.007 | tr | 26 | 69 | OUT |
| 4F | 0.01 | 0.01 | 0.006 | 0.006 | tr | 39 | 75 | WITHIN |
| 4G | tr | 0.01 | 0.015 | 0.006 | tr | 33 | 82 | WITHIN |
| 4H | 0.01 | 0.01 | 0.075 | 0.006 | tr | 42 | 79 | WITHIN |
| 4I | tr | 0.01 | 0.249 | 0.002 | tr | 24 | 81 | WITHIN |
| 4J | tr | 0.01 | 0.426 | 0.006 | tr | 31 | 68 | WITHIN |
| 4K | 0.18 | 0.01 | 0.015 | 0.006 | 0.010 | 42 | 82 | WITHIN |
| 4L | 0.25 | 0.02 | 0.029 | 0.002 | tr | 28 | 81 | WITHIN |
| 4M | tr | 0.01 | 0.020 | 0.004 | tr | 13 | 84 | WITHIN |
| 4N | tr | 0.13 | 0.035 | tr | 0.010 | 25 | 75 | WITHIN |
| 4O | tr | 0.28 | 0.020 | tr | tr | 45 | 77 | WITHIN |
| 4P | 0.21 | 0.02 | 0.026 | tr | 0.012 | 26 | 84 | WITHIN |
| 4Q | 0.16 | 0.21 | 0.019 | tr | tr | 18 | 65 | WITHIN |
| 4R | 0.05 | 0.15 | 0.032 | tr | tr | 35 | 77 | WITHIN |

*) FIGS. FOR B AND N ARE IN ppm.

Subsequently, after pickling, each coil was rolled by a tandem rolling mill into an intermediate thickness of 1.5 mm, and subjected to intermediate annealing. The intermediate annealing comprised preheating to 200° C., heating to 500° C. in 20 seconds, heating from 500 to 1,050° C. at a heating rate of 24° C./sec, holding at 1,050° C. for 30 seconds, and rapidly cooling with water mist at a cooling rate of 25° C./sec. The intermediate annealing atmosphere was a mixed atmosphere having a dew point of 50° C. and comprising 50% $N_2$ and 50% $H_2$, and carbon was eliminated by 0.012% from the surface layer of the steel sheet. Subsequently, each coil was pickled and rolled into a final thickness of 0.22 mm through warm rolling by a Sendzimir mill in which the exit temperature of each rolling pass was within a range of from 170 to 250° C. and a temperature of at least 220° C. is reach on two or more passes. After degreasing, the cold-rolled sheet was subjected to decarburization annealing at 850° C. for two minutes. An annealing separator mainly comprising MgO containing 5% $TiO_2$ was coated onto the surface of the annealed sheet, and then, subjected to final annealing. The final annealing was applied in an 100% $N_2$ atmosphere during heating to 850° C., in a mixed atmosphere of 25% $N_2$ and 75% $H_2$ during heating from 850 to 1,150° C., and in a 100% $H_2$ atmosphere during heating from 1,150 to 1,200° C. and for holding at 1,200° C. for five hours. The unreacted annealing separator was removed from the surface of the annealed sheet. An insulating coating agent mainly comprising magnesium phosphate containing 50% colloidal silica was coated onto the coil surface, and baked at 800° C. Subsequently, a plasma jet was linearly irradiated onto the steel sheet surface at the rolling direction intervals of 5 mm to complete a product.

Figure 4:
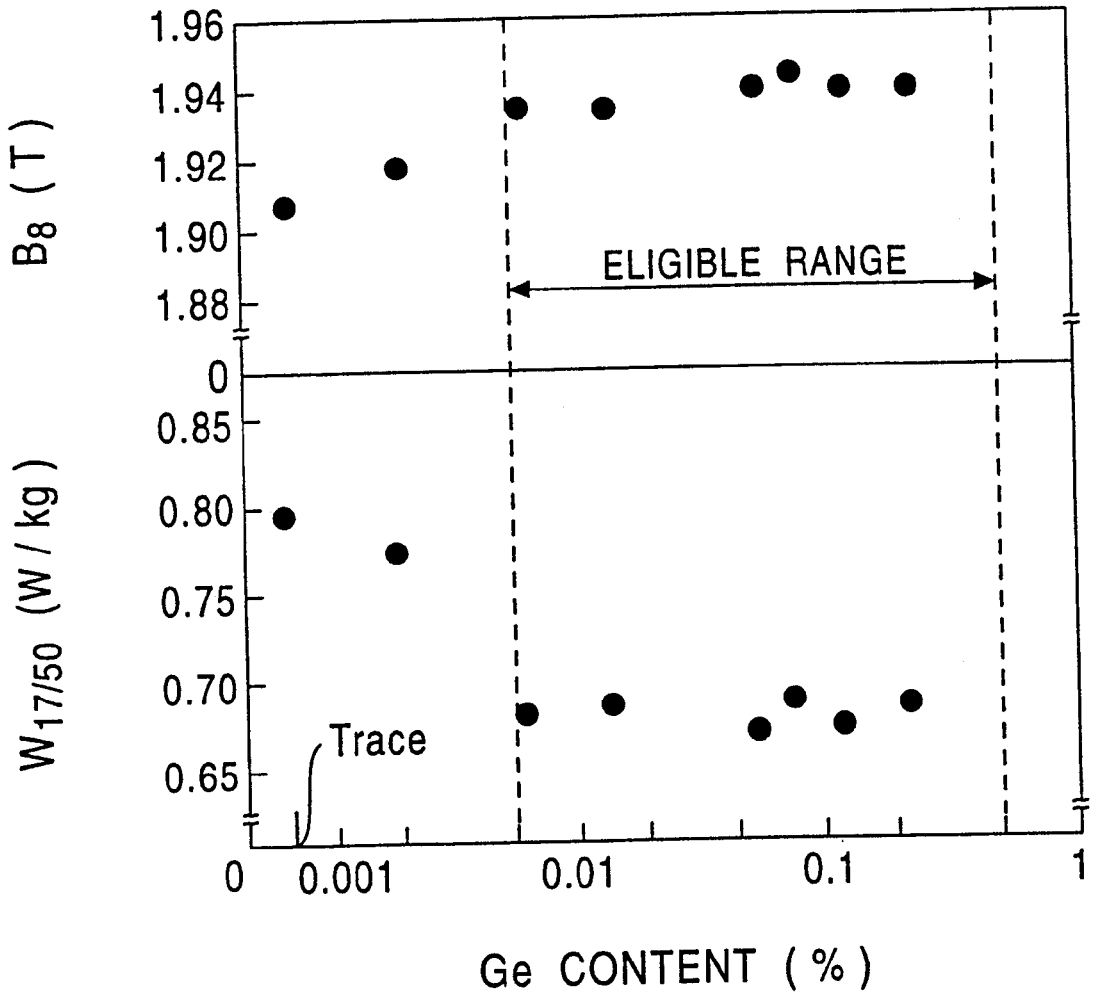
FIG. 4 is a chart which illustrates the effect of germanium content on magnetic properties.

SST test pieces having a width of 100 mm and a length of 400 mm were cut from each product in the rolling direction to measure the iron loss $W_{17/50}$ and the magnetic flux density $B_8$. Measured values relative to the germanium content are comprehensively shown in FIG. 4. As shown in FIG. 4, the grain oriented electromagnetic steel sheets manufactured by using ingots 4A, 4F, 4G, 4H, 4I and 4J having appropriate germanium contents of the invention had a high magnetic flux density and a low iron loss. The final products of 4A, 4F, 4G, 4H, 4I and 4J contained from 0.0005 to 0.0022 wt % carbon, from 3.21 to 3.41 wt % silicon, from 0.07 to 0.08 wt % manganese, from 0.0005 to 0.0010 wt % sulfur, from 0.0005 to up to 0.0015 wt % selenium, from 0.0010 to 0.0027 wt % boron, from 4 to 12 wtppm nitrogen, from 0.0005 to 0.0015 wt % aluminum, from 0.002 to 0.006 wt % vanadium, and from 0.006 to 0.426 wt % germanium.

Example 6

Slabs having a thickness of 200 mm were prepared by continuously casting, while conducting electromagnetic stirring, molten steel having chemical compositions of ingots Nos. 4K and 4L, shown in Table 10. When melting the ingots, the aluminum content in ingot No. 4K was varied within a range of from 0.001 to 0.028% and the vanadium content in ingot No. 4L was varied within a range of from 0.003 to 0.032% by changing the extent of purifying treatments.

After casting, each slab was charged into an induction heating furnace, reheated to 1,380° C. in an hour in $N_2$ gas, and subjected to hot rolling. The slab was rolled by hot rough rolling mill into a thickness of 45 mm, and by hot finishing rolling mill into a thickness of 2.0 mm. The hot rolling time was 120 to 140 seconds. The hot rolling finishing temperature was within a range of from 920 to 960° C. After the end of hot rolling, the sheet was cooled at a cooling rate within a range of from 45 to 70° C./sec, and coiled at a temperature of 550 to 620° C. Further, each coil was subjected to hot-rolled sheet annealing at 1,100° C. for 30 seconds. The hot-band annealing comprised preheating to 300° C., heating to 500° C. in 15 seconds, further heating to 1,100° C. at a heating rate of 15° C./sec, soaking, and rapidly cooling by spraying water mist. The annealing atmosphere of hot-rolled sheet annealing comprised a fuel gas having an air/fuel ratio of 0.95 and a dew point of 45° C., and carbon in an amount of 0.020% was removed from the surface layer of the steel sheet. After pickling, each coil was subjected to warm rolling by a Sendzimir mill in which the maximum stand exit temperature was 250° C. and interpass aging at a temperature of 150 to 230° C. for 10 to 40 minutes, and rolled into a final thickness of 0.34 mm. After degreasing, the sheet was subjected to decarburization annealing at 850° C. for two minutes. An annealing separator mainly comprising MgO containing 7% $TiO_2$ and 2% strontium sulfate was coated onto the surface of the annealed sheet, and the sheet was subjected to final annealing. The final annealing was applied in an 100% $N_2$ atmosphere during heating to 900° C., in a mixed atmosphere of 30% $N_2$ and 70% $H_2$ during heating from 900 to 1,150° C., and in a 100% $H_2$ atmosphere during heating from 1,150 to 1,180° C. and for holding at 1,180° C. for five hours. The unreacted annealing separator was removed from the surface of the annealed sheet. An insulating coating mainly comprising aluminum phosphate containing 60% colloidal silica was coated onto the coil surface, and baked at 800° C., to complete a product.

Figure 5:
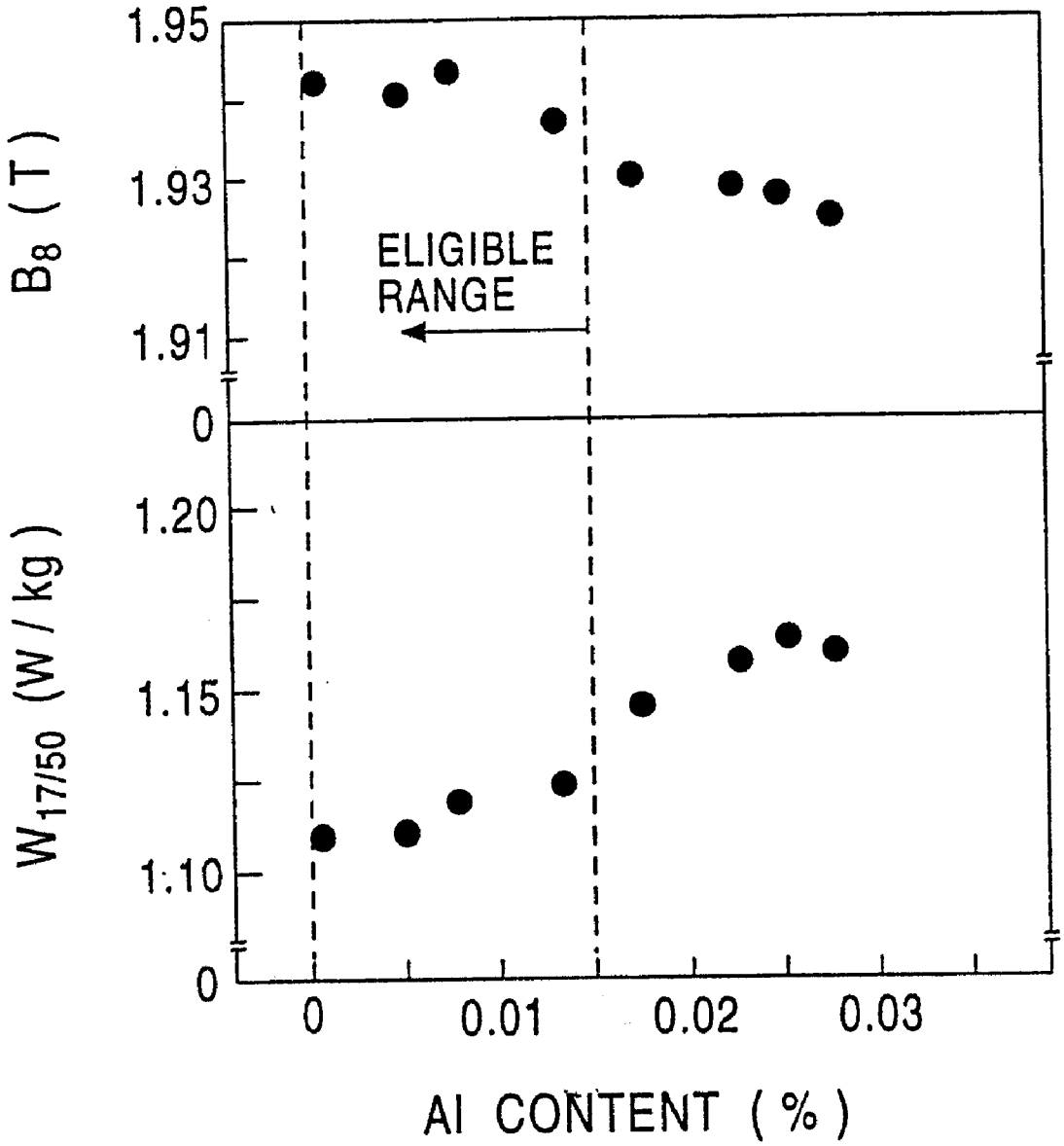
FIG. 5 is a chart which illustrates the effect of the aluminum content.
Figure 6:
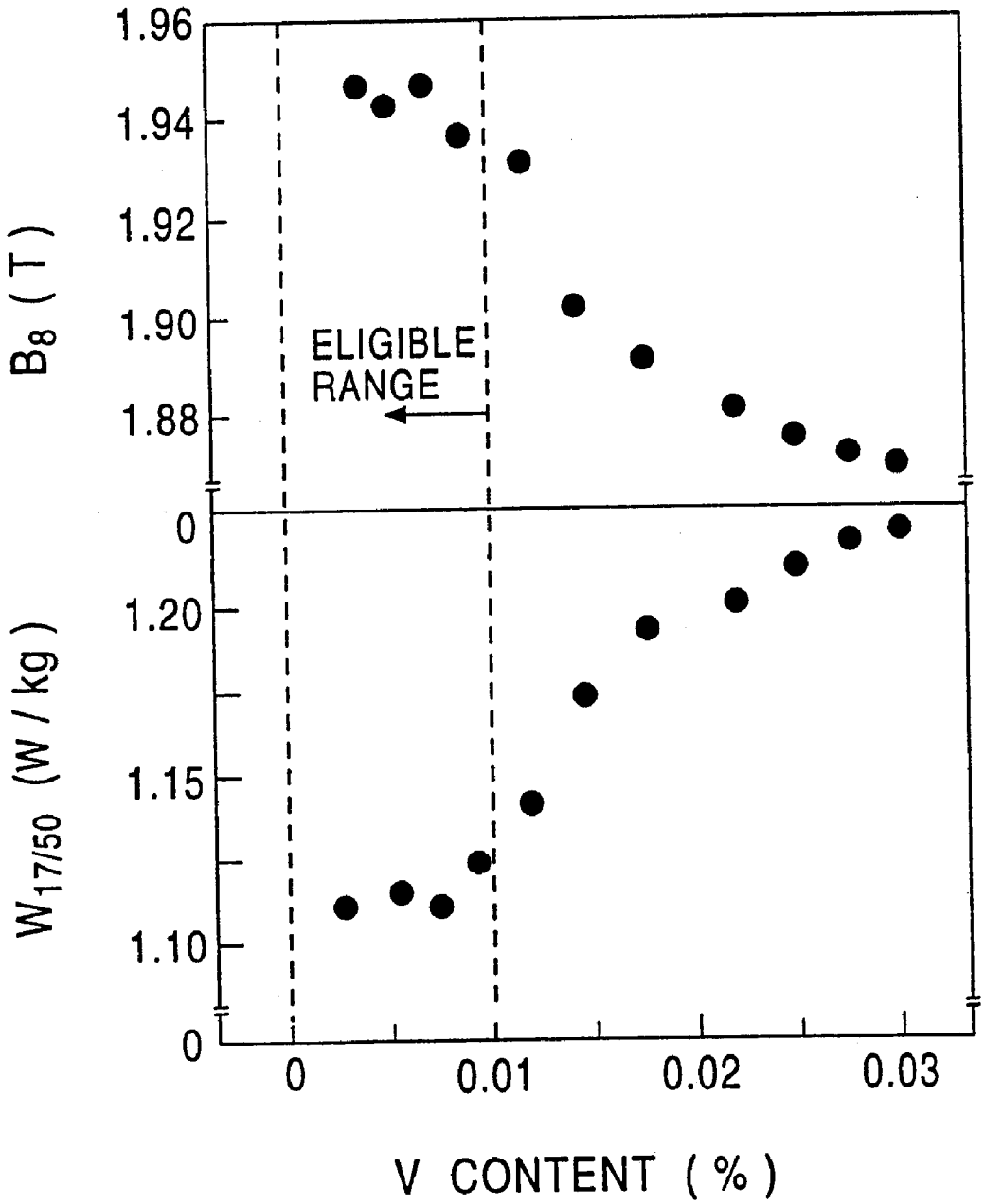
FIG. 6 is a chart which illustrates the effect of vanadium content as indicated in Example 6.

Epstein size test pieces were cut in the rolling direction from each product, and after applying stress relieving annealing at 800° C. for three hours, the iron loss $W_{17/50}$ and the magnetic flux density $B_8$ were measured. The results are shown in FIGS. 5 and 6. As shown in FIGS. 5 and 6, it is necessary to regulate the aluminum content to up to 0.015% and the vanadium content to up to 0.010% as impurities.

Example 7

Steel slabs having a thickness of 70 mm were melted, having chemical compositions of ingot Nos. 4M, 4N and 4D as shown in Table 10, and six each were cast. Each slab was charged in an electric heating furnace, reheated to 1,365° C. and rolled by hot finishing rolling mill into a hot-rolled coil having a thickness of 2.4 mm. For the six coils of ingot No. 4M, the hot rolling period was varied to 25, 40, 55, 120, 210 and 310 seconds by changing the rolling speed. For these coils, the hot rolling finishing temperature was within a range of from 920 to 980° C. Upon completion of hot rolling, the coil was rapidly cooled at a cooling rate within a range of from 45 to 50° C./sec, and coiled at 650° C. For six coils of ingot No. 4N, the hot rolling time was 140 seconds, and the rolling finishing temperature was varied to 1,100, 1,020, 930, 870, 840 and 810° C. by changing the amount of roll coolant water. After further water-cooling the coil at a cooling rate of 38 to 45° C./sec, the coil was wound at 520 to 680° C. into a hot-rolled coil. For all the six coils of ingot No. O, the hot rolling time was 160 seconds, with a hot rolling finishing temperature within a range of from 990 to 1,010° C. After the end of hot rolling, the coil was rapidly cooled at a cooling rate of 42 to 56° C./sec and coiled at 640 to 660° C.

After annealing at 500° C., the coil was pickled, cold-rolled on a tandem mill to a thickness of 1.80 mm, and then subjected to intermediate annealing. Intermediate annealing comprised heating to 500° C. at a heating rate of 20° C./sec, heating from 500 to 1,030° C. at a heating rate of 12° C./sec, holding at 1,030° C. for 60 seconds, and cooling by spraying a water jet for 30 seconds. Subsequently, each coil was subjected to warm rolling by a Sendzimir mill in which the exit temperature for each rolling pass was within a range of from 80 to 270° C. and a temperature of at least 220° C. was reached for two or more passes, and an aging treatment between rolling passes at 100 to 200° C. for 10 to 60 minutes, into a final thickness of 0.26 mm. For the coils of ingot No. O, the maximum exit temperature of rolling pass was varied to 95, 125, 165, 285, 350 and 420° C. Each of these coils was degreased after rolling, and linear grooves having a depth of 20 $\mu$m and a width of 80 $\mu$m were provided on the surface of the steel sheet in parallel with the coil width direction at intervals of 4 mm in the rolling direction. Subsequently, the sheet was subjected to decarburization annealing at 820° C. for two minutes. Then, the nitrogen content in steel was increased to 120 to 150 ppm through a nitriding treatment for 30 seconds at 800° C. in an atmosphere comprising 10% $NH_3$, 70% $N_2$ and 20% $H_2$. An annealing separator mainly comprising MgO mainly comprising 7% $TiO_2$ and 2% tin oxide was coated onto the surface of the annealed sheet, and the sheet was subjected to final annealing. The final annealing was applied at a heating rate of 35° C./hour in an 100% $N_2$ atmosphere during heating to 950° C., in a mixed atmosphere of 35% $N_2$ and 65% $H_2$ during heating from 950° C. to 1,180° C., and in a 100% $H_2$ atmosphere during holding at 1,180° C. for five hours. The unreacted annealing separator was removed from the surface of the annealed sheet. An insulating coating mainly comprising magnesium phosphate containing 60% colloidal silica was coated onto the coil surface, and baked at 800° C. to complete a product.

Epstein test pieces were cut in the rolling direction from each product, and after applying stress relieving annealing at 800° C. for three hours, the iron loss value $W_{17/50}$ and the magnetic flux density $B_8$ were measured. The measured results are shown in Tables 11 to 13. These Tables indicate that in the products satisfying the manufacturing conditions of the invention, both a high magnetic flux density and a low iron loss are enjoyed.

TABLE 11

| INGOT NO. | HOT ROLLING TIME (s) | MAGNETIC PROPERTIES $B_8$ (T) | MAGNETIC PROPERTIES $W_{17/50}$ (W/kg) | ELIGIBLE OR NOT |
|---|---|---|---|---|
| 4M | 25 | 1.876 | 0.883 | NO |
| | 40 | 1.885 | 0.859 | NO |
| | 55 | 1.912 | 0.754 | YES |
| | 120 | 1.918 | 0.743 | YES |
| | 210 | 1.910 | 0.767 | YES |
| | 310 | 1.864 | 0.949 | NO |

TABLE 12

| INGOT NO. | HOT ROLLING FINISHING TEMPERATURE (° C.) | MAGNETIC PROPERTIES $B_8$ (T) | MAGNETIC PROPERTIES $W_{17/50}$ (W/kg) | ELIGIBLE OR NOT |
|---|---|---|---|---|
| 4N | 1100 | 1.907 | 0.773 | YES |
| | 1020 | 1.914 | 0.746 | YES |
| | 930 | 1.921 | 0.733 | YES |
| | 870 | 1.915 | 0.748 | YES |
| | 840 | 1.884 | 0.864 | NO |
| | 810 | 1.866 | 0.952 | NO |

TABLE 13

| INGOT NO. | WARM ROLLING MAXIMUM TEMPERATURE (° C.) | MAGNETIC PROPERTIES $B_8$ (T) | MAGNETIC PROPERTIES $W_{17/50}$ (W/kg) | ELIGIBLE OR NOT |
|---|---|---|---|---|
| 4O | 95 | 1.872 | 0.894 | NO |
| | 125 | 1.880 | 0.862 | NO |
| | 165 | 1.909 | 0.767 | YES |
| | 285 | 1.915 | 0.748 | YES |
| | 350 | 1.912 | 0.765 | YES |
| | 420 | 1.868 | 0.945 | NO |

Example 8

Each one of slabs having the chemical compositions of ingot Nos. 4A to 4R shown in Table 10 was cast into a slab, while conducting electromagnetic stirring, having a thickness of 240 mm. Each slab was charged into a gas heating furnace, and after heating to 1,220° C., charged into an induction heating furnace to heat to 1,380° C. The slab was then subjected to hot rough rolling mill and hot finishing rolling mill into a hot-rolled coil having a thickness of 2.0 mm. The hot rolling time was 180 seconds, and the hot rolling finishing temperature was within a range of from 980 to 1,010° C. After the end of hot rolling, the sheet was cooled at a cooling rate of 55° C./sec, and coiled at 650° C. Further, the coil was subjected to hot-band annealing at 1,100° C. for 40 seconds. The hot-band annealing comprised preheating to 250° C., heating to 500° C. in 20 seconds, heating to 1,100° C. at a heating rate of 15° C./sec, soaking, and cooling by spraying a cooling gas to the steel sheet. After pickling, the annealed sheet was subjected to warm rolling by 4-stand tandem mill, in which the sheet temperature at the exits of the third and fourth stands was within a range of from 220 to 280° C. into an intermediate thickness of 1.40 mm. Subsequently, intermediate annealing was carried out. The intermediate annealing comprised heating to 500° C. at a heating rate of 15° C./sec, heating from 500 to 1,050° C. at a heating rate of 20° C./sec, soaking at 1,050° C. for 40 seconds, and then rapidly cooling by spraying water jet at a cooling rate of 35° C./sec. The annealing atmosphere for the intermediate annealing was a mixed atmosphere having a dew point of 50° C. and comprising 70% $H_2$ and 30% $N_{21}$ and carbon was removed in an amount of 0.015% from the surface layer of the steel sheet. Subsequently, the sheet was subjected to warm rolling by Sendzimir mill, in which the maximum roll bite exit temperature was within a range of from 220 to 260° C., into a final thickness of 0.19 mm. After degreasing, the cold-rolled sheet was subjected to decarburization annealing at 850° C. for two minutes. A annealing separator mainly comprising MgO containing 6% $TiO_2$ and strontium hydroxide was coated onto the surface of the annealed sheet, and the sheet was subjected to final annealing. The final annealing was applied at a heating rate of 35° C./hour for heating to 850° C. in 100% $N_2$, in a mixed atmosphere of 20% $N_2$ and 80% $H_2$ during holding at 850° C. for 25 hours and heating from 800 to 1,100° C., and in a 100% $H_2$ atmosphere during heating from 1,100° C. to 1,150° C. and holding at 1,150° C. for five hours. The annealing separator not having reacted was removed from the surface of the annealed sheet. An insulating coating mainly comprising magnesium phosphate containing 60% colloidal silica was coated onto the coil surface, and baked at 800° C. Further, plasma jets were linearly irradiated onto the steel sheet surface at intervals of 5 mm to complete a product.

SST test pieces having a width of 100 mm and a length of 400 mm were sampled in the rolling direction from each product to measure the iron loss value $W_{17/50}$ and the magnetic flux density $B_8$. The results are shown in Table 14. As is clear from Table 14, the products within the ranges of chemical composition of the invention had a high magnetic flux density and a low iron loss.

TABLE 14

| INGOT NO. | MAGNETIC PROPERTIES $B_8$(T) | MAGNETIC PROPERTIES $W_{17/50}$ (W/kg) | BN PARTICLE FINENESS (AVERAGE DIAMETER SIZE; nm) | REMARKS |
|---|---|---|---|---|
| 4A | 1.943 | 0.654 | 20 | EXAMPLE OF THE INVENTION |
| 4B | 1.940 | 0.795 | 703 | COMPARATIVE EXAMPLE |
| 4C | 1.938 | 0.798 | 14 | COMPARATIVE EXAMPLE |
| 4D | 1.924 | 0.868 | 25 | COMPARATIVE EXAMPLE |
| 4E | 1.942 | 0.788 | 596 | COMPARATIVE EXAMPLE |
| 4F | 1.934 | 0.687 | 135 | EXAMPLE OF THE INVENTION |
| 4G | 1.940 | 0.659 | 42 | EXAMPLE OF THE INVENTION |
| 4H | 1.947 | 0.647 | 19 | EXAMPLE OF THE INVENTION |
| 4I | 1.941 | 0.658 | 16 | EXAMPLE OF THE INVENTION |
| 4J | 1.939 | 0.672 | 13 | EXAMPLE OF THE INVENTION |
| 4K | 1.952 | 0.635 | 38 | EXAMPLE OF THE INVENTION |
| 4L | 1.944 | 0.645 | 26 | EXAMPLE OF THE INVENTION |
| 4M | 1.949 | 0.638 | 21 | EXAMPLE OF THE INVENTION |
| 4N | 1.942 | 0.656 | 28 | EXAMPLE OF THE INVENTION |
| 4O | 1.948 | 0.640 | 18 | EXAMPLE OF THE INVENTION |

TABLE 14-continued

| INGOT NO. | MAGNETIC PROPERTIES $B_8$(T) | MAGNETIC PROPERTIES $W_{17/50}$ (W/kg) | BN PARTICLE FINENESS (AVERAGE DIAMETER SIZE; nm) | REMARKS |
|---|---|---|---|---|
| 4P | 1.946 | 0.648 | 22 | EXAMPLE OF THE INVENTION |
| 4Q | 1.947 | 0.646 | 24 | EXAMPLE OF THE INVENTION |
| 4R | 1.945 | 0.651 | 15 | EXAMPLE OF THE INVENTION |

Example 9

Two slabs having the chemical Composition of ingot No. 4K shown in Table 10 were cast into slabs having a thickness of 240 mm while conducting electromagnetic stirring. Each slab was heated to 1,200° C. in a gas heating furnace, and then charged into an induction heating furnace to reheat to 1,420° C. The reheated slab was rolled by hot rough rolling mill and hot finishing rolling mill into a hot-rolled coil having a thickness of 2.0 mm. The hot rolling time was 140 seconds, and the hot rolling finishing temperature was 980° C. After the end of hot rolling, the sheet was cooled at a cooling rate of 70° C./sec, and coiled at 550° C. The coil was subjected to hot-band annealing at 1,100° C. for 50 seconds. The hot-band annealing comprised preheating to 250° C., heating to 500° C. in 20 seconds, further heating to 1,100° C. at a heating rate of 12° C./sec, soaking, and cooling by spraying a gas onto the steel sheet. Subsequently, after pickling, each coil was subjected to warm rolling by 4-stand tandem mill, in which the sheet temperature at exits of the third and fourth stands was within a range of from 220 to 280° C. into an intermediate thickness of 1.60 mm, and subjected to intermediate annealing. The intermediate annealing comprised heating to 500° C. at a heating rate of 10° C./sec, heating from 500 to 1,080° C. at a heating rate of 15° C./sec, soaking at 1,080° C. for 40 seconds, and rapidly cooling by spraying water jet at a cooling rate of 45° C./sec. The annealing atmosphere for intermediate annealing was a mixed atmosphere having a dew point of 50° C. and comprising 70% $H_2$ and 30% $N_2$, and carbon in an amount of 0.015% was removed from the surface layers of the steel sheet. The annealed sheet was subjected to warm rolling by Sendzimir mill, in which the maximum roll bite exit temperature was within a range of from 220 to 260° C., into a final thickness of 0.19 mm. After degreasing, linear grooves having a depth of 20 $\mu$m and a width of 150 $\mu$m were repeatedly formed by electrolytic etching on the surface of the steel sheet in a direction at 750 to the rolling direction at a pitch of 5 mm in parallel with the rolling direction. Subsequently, decarburization annealing was carried out at 850° C. for two minutes. An annealing separator mainly comprising MgO containing 6% $TiO_2$ and 2% strontium hydroxide was coated onto a surface of the coil, and the coated coil was subjected to final annealing. Another annealing separator comprising CaO, $Al_2O_3$ and MgO was coated onto the other surface of the coil to prevent formation of a forsterite-based insulating film, and the coil was subjected to final annealing. The final annealing comprised heating at a heating rate of 35° C./hour in $N_2$ during heating to 850° C., holding at 850° C. for 15 hours, heating in a mixed atmosphere of 30% $N_2$ and 70% $H_2$ during heating from 850 to 1,100° C., and heating from 1,150 to 1,180° C. and holding at 1,180° C. for five hours in a 100% $H_2$ atmosphere. The annealing separator not having reacted was removed from the surface of the annealed sheet. A forsterite film was uniformly formed on the former coil surface. No forsterite film was formed in contrast on the latter coil surface which had a metallic gloss. An insulating coating mainly comprising magnesium phosphate containing 60% colloidal silica was further coated onto the coil surface coated with the forsterite film, and baked at 800° C. to complete a product. A grain orientation emphasizing treatment was applied onto the coil not covered with a forsterite film by electrolytic etching in a 10% NaCl solution. A tensile film mainly comprising silica and alumina was formed on the treated surface by the sol-gel method, thus completing a product.

SST test pieces having a width of 100 mm and a length of 400 mm were sampled from each product in the rolling direction to measure the iron loss value $W_{17/50}$ and the magnetic flux density $B_8$. The result is shown in Table 15.

TABLE 15

| PRODUCT TYPE | MAGNETIC PROPERTIES $B_8$ (T) | MAGNETIC PROPERTIES $W_{17/50}$ (W/kg) |
|---|---|---|
| FORSTERITE-COATED PRODUCT | 1.918 | 0.645 |
| SILICA-ALUMINA-COATED PRODUCT | 1.924 | 0.598 |

According to the method of the present invention, as described above in detail, it is possible to manufacture an excellent grain oriented electromagnetic steel sheet having a high magnetic flux density and a low iron loss.

What is claimed is:

1. In a method of making a grain oriented electromagnetic steel sheet having a high magnetic flux density and a very low iron loss, from a steel slab comprising about 0.030 to 0.095 wt % carbon, about 1.5 to 7.0 wt % silicon, about 0.03 to 2.50 wt % manganese, about 0.003 to 0.040 wt % sulfur and/or selenium, and about 0.0010 to 0.0070 wt % boron, said steel slab containing nitrogen in an amount of about 30 to 120 wtppm, a limited aluminum impurity of about 0.015 wt % or less, and a limited vanadium impurity of about 0.010 wt % or less, and said slab containing an element effective to accelerate fine precipitation of BN, comprising the steps of:

reheating said steel slab at a temperature of over about 1,350° C., hot-rolling the reheated steel slab to make a sheet, said hot rolling being performed for a period of about 50 to 220 seconds and at a hot rolling finishing temperature of at least about 850° C.;

rapidly cooling said steel sheet after completion of said hot rolling at a cooling rate of at least about 30° C./sec, coil said sheet at a temperature of about 700° C. or less, subjecting said hot-rolling steel sheet to one or more stages of cold rolling under conditions including a final cold rolling reduction of from about 80 to 95% into a final thickness, conducting primary recrystallization annealing of said sheet, coating said sheet with an annealing separator, applying final annealing including applying secondary recrystallization annealing to said sheet, and accelerating said precipitation of BN to improve the texture of primary recrystallized gains of the steel immediately before subjecting the same to said secondary recrystallization annealing with said element present in said steel sheet.

2. The method according to claim 1, wherein said element accelerating fine precipitation of BN is about 0.0005 to 0.100 wt % bismuth.

3. The method according to claim 1, wherein as said element accelerating fine precipitation of BN is about 0.005 to 0.500 wt % germanium, and wherein immediately before secondary recrystallization annealing and after hot rolling, a first annealing is applied at a heating rate of at least about 5° C./sec at a temperature of at least about 500° C. and at an annealing temperature within a range of from about 1,000 to 1,150° C.; and wherein final cold rolling comprises warm rolling at a maximum temperature within a range of from about 150 to 350° C.

4. The method defined in claim 1, further comprising a decarburization annealing, and wherein said element effective to accelerate fine precipitation of BN is present in an amount effective to provide a precipitated BN having a fineness of about 10–500 nm in average diameter in the decarburized sheet.

5. The method according to claim 2, wherein said steel slab contains one or more elements selected from the group consisting of antimony, tin, copper, chromium, nickel and germanium in amounts of from about 0.0010 to 0.080 wt % for antimony, and from about 0.0010 to 1.30 wt % for tin, copper, chromium, nickel and germanium, respectively.

6. The method according to claim 3, wherein said steel sheet contains one or more elements selected from the group consisting of antimony, tin, copper, chromium and nickel in amounts of from about 0.0010 to 0.080 wt % for antimony, and from about 0.0010 to 1.30 wt % for tin, copper chromium and nickel, respectively.

7. The method according to claim 2, wherein, during the period after the primary recrystallization annealing up to the start of said secondary recrystallization, a nitriding treatment is performed comprising incorporating from about 150 to 250 wtppm of nitrogen into said steel sheet.

8. The method according to claim 3, wherein, during the period after the primary recrystallization annealing up to the start of said secondary recrystallization, a nitriding treatment is performed comprising incorporating from about 150 to 250 wtppm of nitrogen into said steel sheet.

9. The method according to any of claims 3, 5 and 7, wherein, during the period after said final cold rolling step up to said final annealing step, a plurality of grooves are formed on the surface of said steel sheet.

10. The method according to any one of claims 2, 5 and 7, wherein a plurality of grooves are formed on the surface of said steel sheet after said final annealing step, whereby an area with a plurality of grooves is formed on the surface of said steel sheet.

11. The method according to any one of claims 2, 5 and 7, wherein a linear strain is formed on the surface of said steel sheet after said final annealing step, whereby an area with a linear strain is formed on the surface of said steel sheet.

12. The method according to any of claims 3, 6 and 8, wherein, during the period between said final cold rolling step and said final annealing step, a plurality of grooves is formed on the surface of said steel sheet, or after said final annealing, an area with a plurality of grooves or/and linear strain is formed on the surface of said steel sheet.

13. The method according to any of claims 3, 6 and 8, wherein after said final annealing a plurality of grooves is formed on the surface of said steel sheet.

14. The method according to any one of claims 3, 6 and 8, wherein, during the period between said final cold rolling step and said final annealing step, a linear strain is formed on the surface of said sheet.

15. The method according to claim 2 further comprising the step of applying an annealing separator to said sheet, thereby inhibiting film formation, and after said final annealing step, forming a tensile film on said sheet.

16. The method according to any one of claims 3, 6 and 8, wherein an annealing separator which inhibits film formation is applied to said sheet, and after said final annealing step, forming a tensile film on said sheet.

17. The method according to claim 9, further comprising the step of applying an annealing separator to said sheet, thereby inhibiting film formation, and after said final annealing step, forming a tensile film on said sheet.

18. In a method of making a grain oriented electromagnetic steel sheet having a high magnetic flux density and a very low iron loss, from a steel slab comprising about 0.030 to 0.095 wt % carbon, about 1.5 to 7.0 wt % silicon, about 0.03 to 2.50 wt % manganese, about 0.003 to 0.040 wt % sulfur and/or selenium, and about 0.0010 to 0.0070 wt % boron, said steel slab containing nitrogen in an amount of about 30 to 120 wtppm, a limited aluminum impurity of about 0.015 wt % or less, and a limited vanadium impurity of about 0.010 wt % or less and said slab containing an element effective to accelerate fine precipitation of BN as one or more selected from the group consisting of 0.0005 to 0.100 wt % bismuth and 0.005 to 0.500 wt % germanium, said method comprising the steps of:

reheating said steel slab at a temperature of over about 1,350° C., hot-rolling the reheated steel slab to make a sheet, said hot rolling being performed for a period of about 50 to 220 seconds and at a hot rolling finishing temperature of at least about 850° C.;

rapidly cooling said steel sheet after completion of said hot rolling at a cooling rate of at least about 30° C./sec, coiling said sheet at a temperature of about 700° C. or less, subjecting said hot-rolled steel sheet to one or more stages of cold rolling under conditions including a final cold rolling reduction of from about 80 to 95% into a final thickness, conducting primary recrystallization annealing of said sheet, coating said sheet with an annealing separator, applying final annealing including applying secondary recrystallization annealing to said sheet, and accelerating said precipitation of BN to improve the texture of primary recrystallized grains of the steel sheet immediately before subjecting the same to said secondary recrystallization annealing with said element present in said steel sheet.

19. In a method of making a grain oriented electromagnetic steel sheet having a high magnetic flux density and a very low iron loss, from a steel slab comprising about 0.030 to 0.095 wt % carbon, about 1.5 to 7.0 wt % silicon, about 0.03 to 2.50 wt % manganese, about 0.003 to 0.040 wt % sulfur and/or selenium, and about 0.0010 to 0.0070 wt % boron, said steel slab containing nitrogen in an amount of about 30 to 120 wtppm, a limited aluminum impurity of about 0.015 wt % or less, and a limited vanadium impurity of about 0.010 wt % or less, and said slab containing an element effective to accelerate fine precipitation of BN as one or more selected from the group consisting of 0.0005 to 0.100 wt % bismuth and 0.005 to 0.500 wt % germanium, said method comprising the steps of:

reheating said steel slab at a temperature of over about 1,350° C., hot-rolling the reheated steel slab to make a sheet, said hot rolling being performed for a period of about 50 to 220 seconds and at a hot rolling finishing temperature of at least about 850° C.;

rapidly cooling said steel sheet after completion of said hot rolling at a cooling rate of at least about 30° C./sec, coiling said sheet at a temperature of about 700° C. or less, subjecting said hot-rolled steel sheet to one or more stages of cold rolling under conditions including a final cold rolling reduction of from about 80 to 95% into a final thickness, conducting primary recrystallization annealing of said sheet, coating said sheet with an annealing separator, applying final annealing including applying secondary recrystallization annealing to said sheet, and accelerating said precipitation of BN to a fineness of about 10–500 nm in average diameter to improve the texture of primary recrystallized grains of the steel sheet immediately before subjecting the same to said secondary recrystallization annealing.

20. A method of making a grain oriented electromagnetic steel sheet from steel slab comprising about 0.030 to 0.095 wt % carbon, about 1.5 to 7.0 wt % silicon, about 0.03 to 2.50 wt % manganese, about 0.003 to 0.040 wt % sulfur and/or selenium, about 0.0010 to 0.0070 wt % boron, and about 30 to 120 wtppm nitrogen in which said sheet is subjected to secondary recrystallization annealing, comprising the steps of:

incorporating into said sheet prior to said secondary recrystallization annealing reactive amounts of said silicon, said nitrogen, and an element selected from the group consisting of bismuth, germanium and mixtures thereof, and performing said secondary recrystallization annealing under conditions wherein said element is used in accelerating precipitation of fine BN in said steel, said conditions including:

having a heating rate in a first annealing in a cold rolling process higher than about 5° C./sec in a temperature over 500° C.;

having a temperature of the first annealing higher than at least about 950° C. if said element contains bismuth only and 1,000° C. if said element contains germanium; and having a final cold rolling within the range of about 80% to 95%.

21. The method defined in claim 20, further comprising a decarburization annealing, and wherein the fineness of said BN is about 10–500 nm in average diameter in said steel sheet.

22. A method of making a grain oriented electromagnetic steel sheet, said sheet comprising an inhibitive amount of boron, comprising the steps of:

subjecting said steel sheet to primary recrystallization annealing followed by secondary recrystallization annealing;

subsequent to said primary recrystallization annealing and prior to commencement of said secondary recrystallization, applying a nitriding treatment to said steel sheet by adding nitrogen in an amount of from about 150–250 wtppm;

coprecipitating silicon and nitrogen as silicon nitride before conducting said secondary recrystallization annealing, and thereby introducing at least about 50 wtppm of supersturated nitrogen into said steel; and subjecting said steel, in the presence of said boron, said silicon and said nitrogen, to a first annealing with cold rolling, having an annealing temperature higher that at least about 950° C. if said element contains bismuth only and 1,000° C. if said element contains germanium, and having a heating rate in a first annealing higher than about 5° C./sec in a temperature over 500° C.;

final cold rolling said steel sheet within the range of about 80% to 95%;

subsequently heating said steel thereby converting at least some of said silicon nitride into finely divided boron nitride; and performing secondary recrystallization annealing wherein said boron nitride is precipitated in finely divided form into said steel using an element contained in said steel to accelerate said precipitation, and serves as a powerful inhibitor of growth of crystal grains of a particular orientation in said steel during said secondary recrystallization step.

23. The method defined in claim 22, further comprising a decarburization annealing, and wherein the fineness of said BN is about 10–500 nm in average diameter in said steel sheet.

* * * * *

UNITED STATES PATENT AND TRADEMARK OFFICE

CERTIFICATE OF CORRECTION

PATENT NO. : 6,444,051 B2
DATED : September 3, 2002
INVENTOR(S) : Komatsubara et al.

It is certified that error appears in the above-identified patent and that said Letters Patent is hereby corrected as shown below:

Column 10,
Line 63, please change "(co-orientation)" to -- (ω-orientation) --.

Column 18,
Table 5, at No. "3N" at the subheading "Si" please change "3.26" to -- 3.28 --.

Column 25,
Table 10, at No. "4R" at the subheading "Sb" please change "0.013" to -- 0.011 --.

Column 30,
Line 14, please change "$N_{21}$" to -- $N_{2,}$ --; and under Table 14, at "INGOT NO." at 4B at the subheading "$W_{17/50}$(W/kg)", please change "0.795" to -- 0.785 --.

Signed and Sealed this

Fifth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,444,051 B2 Page 1 of 1
DATED : September 3, 2002
INVENTOR(S) : Komatsubara et al.

It is certified that error appears in the above-identified patent and that said Letters Patent is hereby corrected as shown below:

Column 32,
Line 65, please change "coil" to -- coiling --.

Column 33,
Line 56, please change "The method according to any of claims 3" to -- The method according to any of claims 2 --.

Signed and Sealed this

Twenty-fifth Day of November, 2003

JAMES E. ROGAN
*Director of the United States Patent and Trademark Office*